US011363877B2

(12) United States Patent
Wright et al.

(10) Patent No.: US 11,363,877 B2
(45) Date of Patent: Jun. 21, 2022

(54) BACKPACK SYSTEM HAVING A DEPLOYABLE FRAME

(71) Applicant: CATALYST LIFESTYLE LIMITED, Hong Kong (CN)

(72) Inventors: Joshua Wright, Hong Kong Sar (CN); June Lai, Hong Kong Sar (CN)

( * ) Notice: Subject to any disclaimer, the term of this patent is extended or adjusted under 35 U.S.C. 154(b) by 3 days.

(21) Appl. No.: 16/657,519

(22) Filed: Oct. 18, 2019

(65) Prior Publication Data

US 2021/0112952 A1 Apr. 22, 2021

(51) Int. Cl.
*A45F 3/08* (2006.01)
*A45F 3/04* (2006.01)

(52) U.S. Cl.
CPC ..... *A45F 3/08* (2013.01); *A45F 3/047* (2013.01); *A45F 2003/045* (2013.01)

(58) Field of Classification Search
CPC .... A45F 3/08; A45F 3/10; A45F 3/047; A45F 2003/045; A45F 4/02; A45F 3/04; A45F 2004/026; A45F 4/06
USPC ..... 224/633–637
See application file for complete search history.

(56) References Cited

U.S. PATENT DOCUMENTS 3,860,157 A * 1/1975 Richards ..... A45F 3/08 224/153
4,074,839 A * 2/1978 Wood ..... A45F 3/08 224/635
5,209,381 A * 5/1993 Jay ..... A45F 4/02 224/155
5,303,975 A * 4/1994 Asato ..... A45F 4/02 224/155
5,704,530 A * 1/1998 Scherer ..... A45F 3/047 224/632
5,725,139 A * 3/1998 Smith ..... A45F 3/02 224/637
5,819,999 A * 10/1998 Tennant ..... A47C 4/52 224/155
6,210,037 B1 4/2001 Brandon, Jr.
6,315,177 B1 * 11/2001 Weatherall ..... A45F 4/02 224/259
6,698,827 B2 * 3/2004 Le Gette ..... A47C 7/66 297/16.2
7,028,873 B1 * 4/2006 Collier ..... A45F 3/08 224/628
8,118,201 B1 * 2/2012 Calkin ..... A45F 3/08 224/156
8,579,171 B2 * 11/2013 Gleason, Jr. ..... A45F 3/06 224/631

(Continued)

FOREIGN PATENT DOCUMENTS

DE 102017112759 12/2018

OTHER PUBLICATIONS

"Hikelite 26." Osprey Packs, Inc. Web. Accessed Oct. 18, 2019. https://www.osprey.com/hk/en/product/hikelite-26-HIKELITE26_809.html.
"Arc Blast 55L Backpack." Zpacks. Web. Accessed Oct. 18, 2019. https://zpacks.com/products/arc-blast-backpack.

(Continued)

*Primary Examiner* — Adam J Waggenspack

(57) ABSTRACT

A backpack system is disclosed. The backpack system may include a frame, a carrier portion, and a backpack portion. The frame deploys to a deployed state and collapses to a collapsed state, the carrier portion defines an upper pocket and a lower pocket that constrain the frame in the deployed state, and the backpack portion is removably couplable to the carrier portion.

17 Claims, 13 Drawing Sheets

(56) References Cited

U.S. PATENT DOCUMENTS

| | | | | |
|---|---|---|---|---|
| 9,060,590 | B2 | 6/2015 | Valesko | |
| 9,119,459 | B2 * | 9/2015 | Kim | A45F 3/08 |
| 9,131,762 | B2 * | 9/2015 | Buffinton | A45F 3/08 |
| 9,271,560 | B2 * | 3/2016 | Buffinton | A45F 3/08 |
| D764,873 | S | 8/2016 | Collie | |
| D819,328 | S | 6/2018 | Muhlenkamp, IV | |
| 10,182,640 | B2 * | 1/2019 | Holtz | A45F 4/02 |
| D842,603 | S | 3/2019 | Johnson | |
| D857,377 | S | 8/2019 | Hong | |
| D860,639 | S | 9/2019 | Thibadeau | |
| D876,082 | S | 2/2020 | Jais | |
| D876,826 | S | 3/2020 | Watson et al. | |
| D878,742 | S | 3/2020 | Xu | |
| 10,694,834 | B2 * | 6/2020 | Logan | A45F 4/02 |
| 10,842,245 | B2 * | 11/2020 | Revels | A45F 3/08 |
| 2010/0032464 | A1 * | 2/2010 | Gleason, Jr. | A45F 3/08 224/631 |
| 2010/0176171 | A1 * | 7/2010 | Araujo | A45F 3/08 224/600 |
| 2013/0126564 | A1 * | 5/2013 | Savage, Sr. | A45F 4/02 224/155 |
| 2014/0339277 | A1 | 11/2014 | Law | |
| 2015/0342325 | A1 * | 12/2015 | Wright | A45F 3/04 224/642 |
| 2019/0343267 | A1 * | 11/2019 | Drew | A45F 3/24 |

OTHER PUBLICATIONS

Wandrd. "VEER 18 | Packable Bag and Inflatable Camera Protection." Kickstarter. Web. Accessed Oct. 18, 2019. https://www.kickstarter.com/projects/wandrd/veer-18-packable-bag-and-inflatable-camera-protect?ref=discovery&term=travel%20backpack.

Zhang Yixin. "Marmot 18L Kompressor Backpack." YouTube, May 30, 2019, https://www.youtube.com/watch?v=GRRvPHCqmmw.

"Fjällräven Kånken." aalto sukelluskoulu. Web. Accessed Oct. 18, 2019. https://sukelluskouluaalto.fi/en/Fj%C3%A4llr%C3%A4ven+K%C3%A5nken?_tu=217.

FrantaB. "Improving comfort of packable backpack." Reddit, Apr. 15, 2019. Web. https://www.reddit.com/r/onebag/comments/bde2ih/improving_comfort_of_packable_backpack/.

Catalyst. "Catalyst Ultra Lightweight Weatherproof Waterproof Collapsible Backpack 10 000mm Ultra Resistant Fabric, Tactical Military Gear for Exotic Places, Hiking, Dry Bag Black Backpack Daypack Packable." Amazon.com, Inc., May 2, 2018. Web. https://www.amazon.com/Catalyst-Lightweight-Weatherproof-Waterproof-Collapsible/dp/B07CTF1339/.

"Cascade Waterproof Backpack (35L)-WXP-1." Stormtech USA Retail, 2018. Web. https://www.stormtechusa.com/products/cascade-waterproof-backpack-35-l-wxp-1.

"Waterproof Backpack Dry Tube—60 Litres." OverBoard Ltd, 2015. Web. https://www.over-board.com/products/waterproof-backpack-dry-tube-60ltr-black.

Non-Final Office Action cited in U.S. Appl. No. 29/667,746 dated Apr. 15, 2020, 7 pages.

* cited by examiner

BACKPACK SYSTEM HAVING A DEPLOYABLE FRAME

BACKGROUND

Field

The present disclosure generally relates to a backpack system, and more specifically, to a backpack system that includes a deployable frame.

Technical Background

Conventional backpack systems may include a rigid or semi-rigid frame. However, a problem with such backpack systems is that they are not easily stowable due to the rigid or semi-rigid nature of the frame. Furthermore, during manufacture, a sack or bag portion may be permanently affixed (e.g., sewn) to the rigid or semi-rigid frame. Accordingly, a backpack system is desired that includes a frame capable of not only maintaining the requisite structural rigidity during use but also being easily stowable when not in use.

SUMMARY

In one aspect, a backpack system may include a frame, a carrier portion, and a backpack portion. The frame deploys to a deployed state and collapses to a collapsed state, the carrier portion defines an upper pocket and a lower pocket that constrains the frame in the deployed state, and the backpack portion is removably couplable to the carrier portion.

In another aspect, a backpack system may include a frame. The frame deploys to a deployed state, collapses to a collapsed state, and is removably insertable within an upper pocket and a lower pocket defined by a carrier portion to constrain the frame in the deployed state.

In yet another aspect, a backpack system may include: a backpack portion defining a surface, the surface of the backpack portion to interface with a carrier portion having a deployable frame positioned within an upper and lower pocket of the carrier portion, and at least one of a sleeve defined on the surface of the backpack portion or one or more than one attachment mechanism positioned on the surface of the backpack portion to removably couple the backpack portion and the carrier portion.

Additional features and advantages of the embodiments described herein will be set forth in the detailed description which follows, and in part will be readily apparent to those skilled in the art from that description or recognized by practicing the embodiments described herein, including the detailed description which follows, the claims, as well as the appended drawings.

It is to be understood that both the foregoing general description and the following detailed description describe various embodiments and are intended to provide an overview or framework for understanding the nature and character of the claimed subject matter. The accompanying drawings are included to provide a further understanding of the various embodiments, and are incorporated into and constitute a part of this specification. The drawings illustrate the various embodiments described herein, and together with the description serve to explain the principles and operations of the claimed subject matter.

DETAILED DESCRIPTION

Reference will now be made in detail to various backpack systems. Each backpack system may include a backpack portion and a carrier portion having a frame configured to be deployable and collapsible. According to various aspects, the frame may include a plurality of frame segments where each frame segment is configured to couple to an adjacent frame segment. When in a deployed state (e.g., in use), each end of each frame segment may be removably coupled to its adjacent frame segments to form an overall rigid or semi-rigid frame. When in a collapsed state (e.g., not in use), each end of each frame segment may be decoupled from its adjacent frame segments to form an assembly of frame segments. In some aspects, each end of each frame segment may be uniquely identified for a user to appropriately couple matching identifiers to form the rigid or semi-rigid frame. In other aspects, each end of each frame segment may be maintained (e.g., when in a deployed state and when in a collapsed state) in association with its appropriate adjacent frame segment via a rope or cord. In some aspects, the rope or cord may be longer than, shorter than, or equal in length to a combined length of the frame segments when coupled together (e.g., in the deployed state). According to aspects described herein, the rope or cord may be an elastic rope or cord (e.g., bungee cord or shock cord) that is shorter in length than the combined length of the frame segments when coupled together such that a tensile force is generated within the rope or cord to keep the ends the plurality of frame segments coupled together in the deployed state.

The various backpack systems are illustrated in the accompanying drawings. Whenever possible, the same reference numbers will be used throughout the drawings to refer to the same or like parts.

Figure 1:
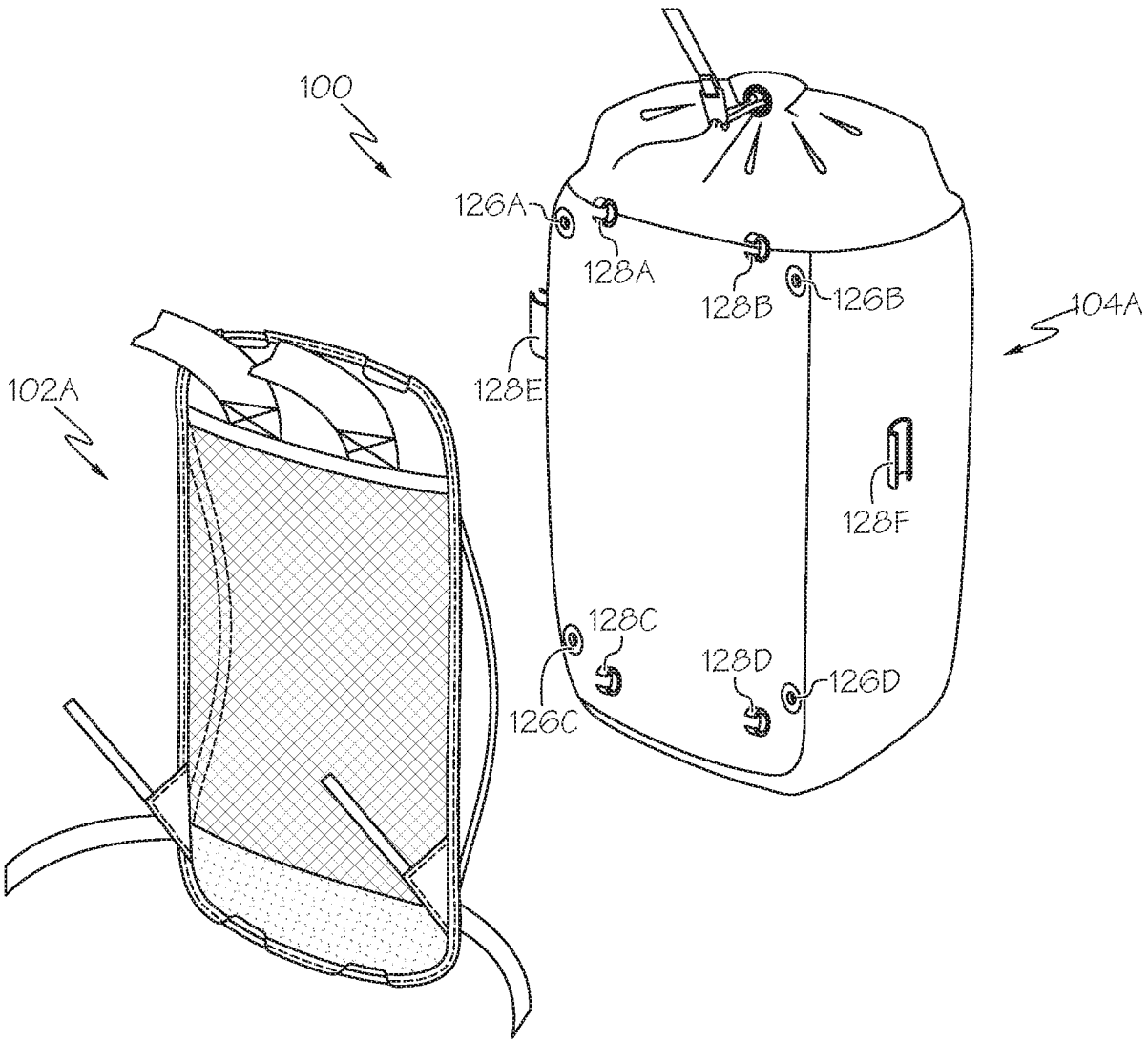
FIG. 1 depicts an exploded view of an illustrative backpack system including an illustrative carrier portion and an illustrative backpack portion, according to one or more embodiments shown and described herein.

FIG. 1 depicts an exploded view of an illustrative backpack system 100 including a carrier portion 102A and a backpack portion 104A according to one or more aspects of the present disclosure. As described more fully herein, the backpack portion 104A is configured to be removably coupled, via a plurality of attachment points, to the carrier portion 102A. As illustrated in FIG. 1, the plurality of attachment points may include a first plurality of attachment mechanisms 126A, 126B, 126C, 126D or the like and/or a second plurality of attachment mechanisms 128A, 128B, 128C, 128D, 128E, 128F or the like associated with the backpack portion 104A as described herein. The backpack portion 104A, as depicted in FIG. 1, is illustrative and may include further features such as zippered enclosures, snap enclosures, interior pockets, exterior pockets, water bottle holders, accessory holders, headphone ports, and/or the like.

Figure 2:
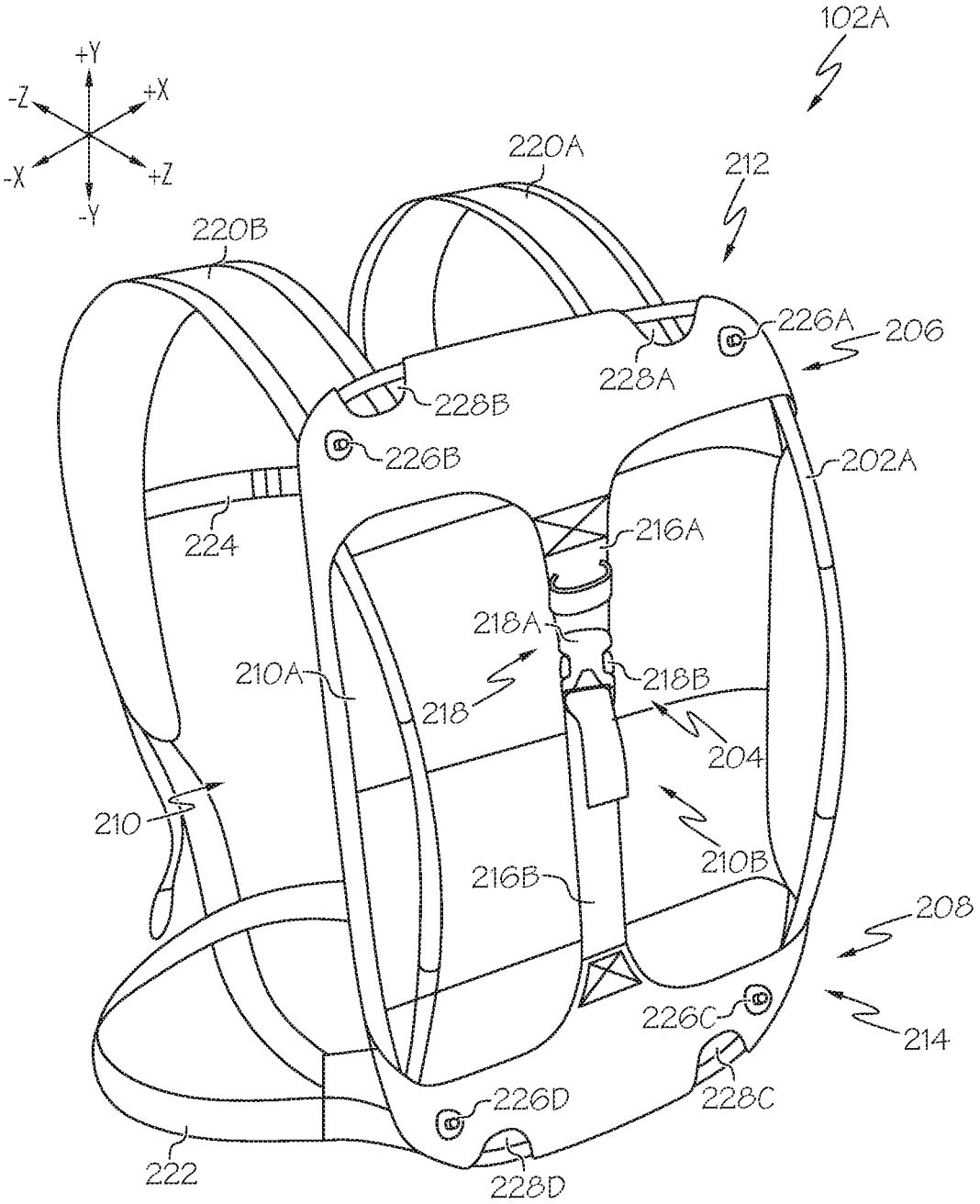
FIG. 2 depicts a perspective view of the illustrative carrier portion of FIG. 1, the carrier portion including a deployable frame, according to one or more embodiments shown and described herein.

FIG. 2 depicts a perspective view of the illustrative carrier portion 102A of FIG. 1, the carrier portion 102A including a deployable frame 202A, according to various aspects of the present disclosure. Referring to FIG. 2, the carrier portion 102A may define a frame cavity 204 configured to constrain the frame 202A in its deployed state. In some aspects, the frame cavity 204 may be configured to not only constrain the frame 202A but also cause the frame 202A to deflect to a bowed or curved state, as described herein. The frame cavity 204 may extend from an upper pocket 206 (e.g., positioned towards the +y direction of the coordinate axes of FIG. 2) locatable about the shoulder area of a backpack user and a lower pocket 208 (e.g., positioned towards the −y direction of the coordinate axes of FIG. 2) locatable about the hip area of the backpack user. A middle section 210 of the carrier portion 102A may connect the upper pocket 206 and the lower pocket 208. According to various aspects, the frame cavity 204 of the carrier portion 102A may be defined by at least one material. In some aspects, the upper pocket 206 and the lower pocket 208 may be defined by a same first material. In such aspects, the upper pocket 206 and/or the lower pocket 208 may be formed by folding a flap of the first material over and fixedly attaching (e.g., sewing) the first material to itself (e.g. to form the upper pocket 206 and/or the lower pocket 208 as illustrated in FIG. 2). According to other aspects, the upper pocket 206 and/or the lower pocket 208 may include more than one (e.g., different) material. For example, in such aspects, the upper pocket 206 and/or the lower pocket 208 may be formed by fixedly attaching (e.g., sewing) a first material to a second material (e.g., to form the upper pocket 206 and/or the lower pocket 208 as illustrated in FIG. 2).

The middle section 210, which connects the upper pocket 206 and the lower pocket 208, may include a material that is the same as or different from the material of the upper pocket 206 and/or the lower pocket 208. Referring to FIG. 2, the middle section 210 may include a posterior middle section 210A (e.g., positioned towards the −z direction of the coordinate axes of FIG. 2) and an anterior middle section 210B (e.g., positioned towards the +z direction of the coordinate axes of FIG. 2). The anterior middle section 210B may include at least one strap configured to removably couple the upper pocket 206 and the lower pocket 208. In some aspects, the anterior middle section 210B may include an upper strap 216A (e.g., positioned towards the +y direction of the coordinate axes of FIG. 2) and a lower strap 216B (e.g., positioned towards the −y direction of the coordinate axes of FIG. 2). In such an aspect, the upper strap 216A may include a first end fixedly coupled to the upper pocket 206 and a second end fixedly or adjustably coupled to a first buckle element 218A of a buckle 218 and the lower strap 216B may include a first end fixedly or adjustably coupled to a second buckle element 218B (e.g., removably insertable within the first buckle element 218A) of the buckle 218 and a second end fixedly coupled to the lower pocket 208. According to various aspects described herein, the posterior middle section 210A and/or the anterior middle section 210B may include one or more than one material having an elasticity configured to cause (e.g., in combination with the upper pocket 206 and the lower pocket 208) the frame 202A to deflect to the bowed or curved state, as depicted in FIG. 2 (e.g., in the +z direction of the coordinate axes of FIG. 2). In such aspects, an upper frame portion 212 of the frame 202A may be positioned within the upper pocket 206, a lower frame portion 214 of the frame 202A may be positioned within the lower pocket 208 and the first buckle element 218A may be removably coupled to the second buckle element 218B. According to various aspects, when positioned within the frame cavity 204, the frame 202A may be configured to maintain the posterior middle section 210A in tension to create a semi-rigid tensile structure of the posterior middle section 210A. In such aspects, the semi-rigid tensile structure may create air-flow for comfort, create a structure that maintains a backpack shape, and/or create a structure to maintain a separation between the backpack and the backpack user (e.g., such that object(s) in the backpack cannot poke the backpack user in the back). According to various aspects, the frame 202A may deflect from an non-deflected state a predetermined amount. According to various aspects, the upper strap 216A may be adjustable via the first buckle element 218A and/or the lower strap 216B may be adjustable via the second buckle element 218B to modify an amount of deflection of the frame 202A.

Still referring to FIG. 2, the carrier portion 102A may further include shoulder straps 220A, 220B, a waist belt 222, and/or a chest strap 224, as described more fully herein. In some aspects, an anterior surface (e.g., in the +z direction of the coordinate axes of FIG. 2) of the upper pocket 206 and/or the lower pocket 208 may include one or more than one attachment mechanism 226A, 226B, 226C, 226D (e.g., male and/or female snaps, hooks and/or loops, and/or the like) to removably couple the backpack portion 104A and the carrier portion 102A. In such aspects, referring briefly to FIG. 1, the backpack portion 104A may include one or more than one corresponding attachment mechanism 126A, 126B, 126C, 126D (e.g., female and/or male snaps, loops and/or hooks, and/or the like) located to mate with each of the one or more than one attachment mechanism 226A, 226B, 226C, 226D of the carrier portion 102A. Furthermore, at least one upper access void 228A, 228B may be defined in the upper pocket 206 and at least one lower access void 228C, 228D may be defined in the lower pocket 208. Each upper access void 228A, 228B may expose a section of the upper frame portion 212 as positioned within the upper pocket 206 and each lower access void 228C, 228D may expose a section of the lower frame portion 214 as positioned within the lower pocket 208. Referring briefly again to FIG. 1, the backpack portion 104A may include one or more than one attachment mechanism 128A, 128B, 128C, 128D located and configured to couple to each respective exposed section of the frame 202A. In some aspects, the backpack portion 104A may include one or more than one further attachment mechanism 128E, 128F located (e.g., in a +x direction and/or a −x direction of the coordinate axes of FIG. 2, respectively) and configured to couple to an exposed portion of the frame 202A. According to various aspects, the one or more than one attachment mechanism 128A, 128B, 128C, 128D, 128E and/or 128F may each include a strap with a first attachment portion (e.g., male snap portion, hook tab, and/or the like) positioned on a first end of the strap and a second, corresponding attachment portion (e.g., female snap portion, loop tab, and/or the like) positioned on a second end of the strap, and where the first end of the strap and the second end of the strap are configured to loop around the exposed section of the frame 202A such that the first attachment portion is couplable to the second corresponding attachment portion to couple to the frame 202A. According to other aspects, the one or more than one attachment mechanism 128A, 128B, 128C, 128D, 128E and/or 128F may each include a strap with a first attachment portion (e.g., male snap portion, hook tab, and/or the like) positioned on a first end of the strap and on a second end of the strap, and where the first attachment portion positioned on the first end of the strap and on the second end of the strap are couplable to a second, corresponding attachment portion (e.g., female snap portion, loop tab, and/or the like) positioned on the exposed section of the frame 202A to couple to the frame 202A. According to further aspects, the one or more than one attachment mechanism 128A, 128B, 128C, 128D, 128E and/or 128F may each include a strap with a first attachment portion (e.g., male snap portion, hook tab, and/or the like) positioned on the strap or just the first attachment portion (e.g., male snap portion, hook tab, and/or the like) itself (e.g., without a strap) and where the first attachment portion positioned on the strap or the first attachment portion itself is couplable to a second, corresponding attachment portion (e.g., female snap portion, loop tab, and/or the like) positioned on the exposed section of the frame 202A to couple to the frame 202A. According to still further aspects, the one or more than one attachment mechanism 128A, 128B, 128C, 128D, 128E and/or 128F may each include a molded clip, where each molded clip is sized and/or shaped to clip to the exposed section of the frame 202A to couple to the frame 202A.

Figure 3B:
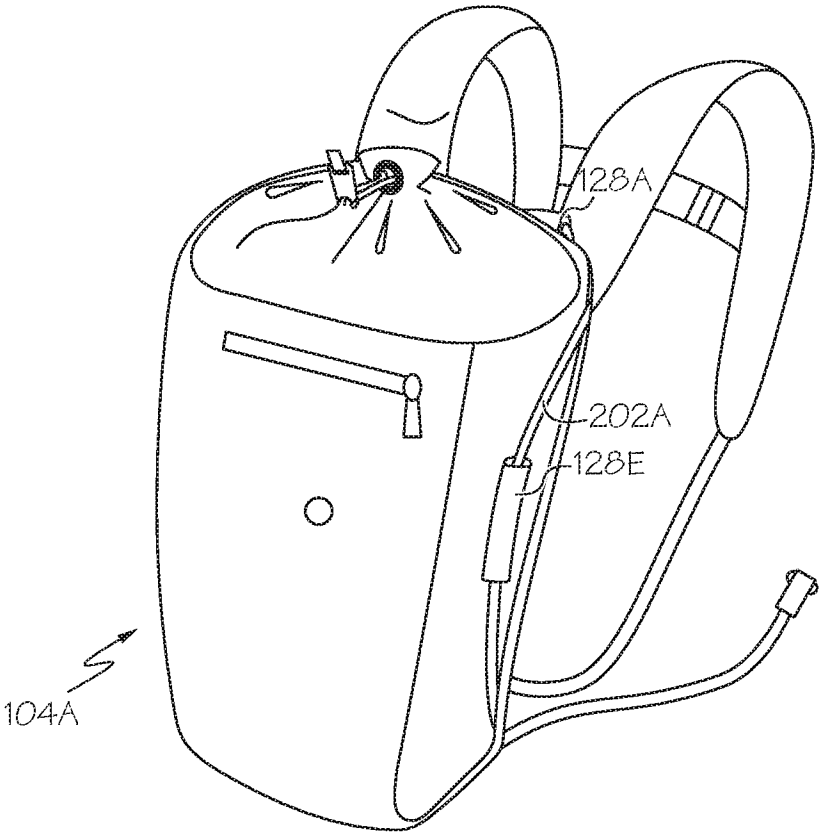
FIG. 3B depicts a front perspective view of the backpack portion of FIG. 1 coupled to the carrier portion of FIG. 1, according to one or more embodiments shown and described herein.
Figure 3A:
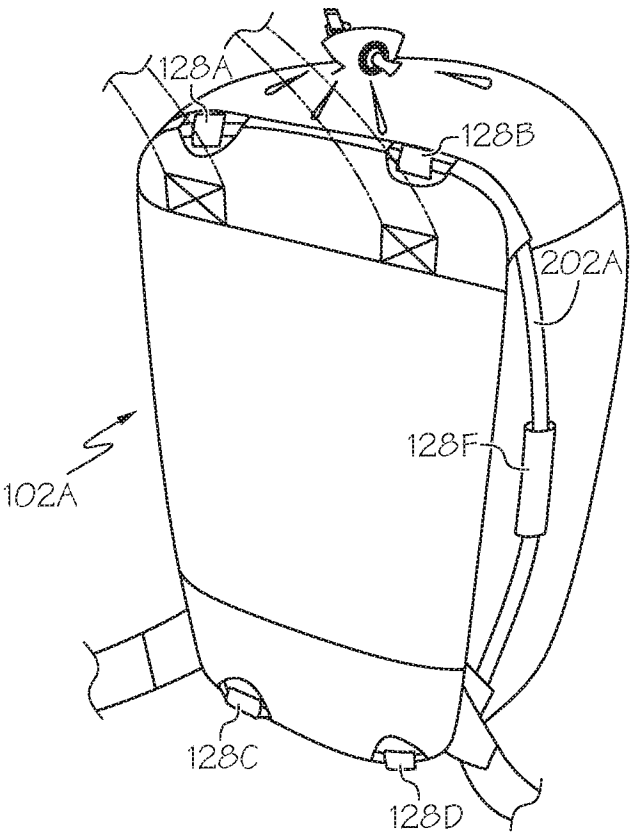
FIG. 3A depicts a back perspective view of the backpack portion of FIG. 1 coupled to the carrier portion of FIG. 1, according to one or more embodiments shown and described herein.

FIGS. 3A-3B depict the backpack portion 104A of FIG. 1 coupled to the carrier portion 102A of FIG. 1, according to various aspects of the present disclosure. In some aspects, each attachment mechanism 128A, 128B, 128C, 128D, 128E, 128F may include a piece of material (e.g., a strap) with a first component of the attachment mechanism (e.g., male snap, hook, and/or the like) on one end and a second mating component of the attachment mechanism (e.g., female snap, loop, and/or the like) on the other end. According to such aspects, each piece of material may be a length sufficient to wrap around the frame 202A, to removably couple each respective first component and second mating component, and to adjustably secure (e.g., snug fit) the backpack portion 104A to the carrier portion 102A.

Figure 4A:
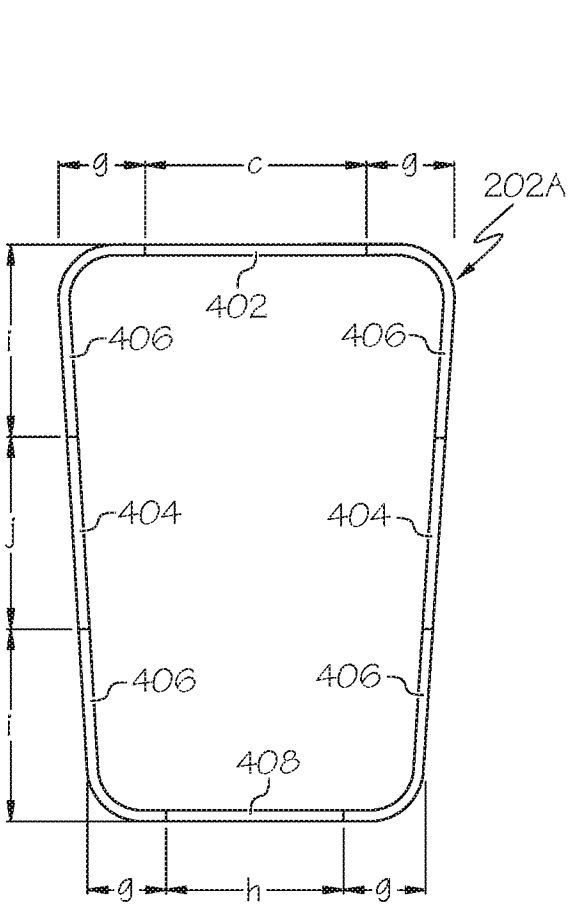
FIG. 4A depicts a front view of an illustrative deployable frame of the carrier portion of FIG. 1, according to one or more embodiments shown and described herein.

FIG. 4A depicts a front view of the illustrative deployable frame 202A of the carrier portion 102A of FIG. 1, according to various aspects of the present disclosure. Referring to FIG. 4A, a plurality of frame segments may be coupled to form one continuous deployable frame 202A. In various aspects, the plurality of frame segments may be coupled to form one continuous "x"-sided deployable frame 202A (e.g., a four-sided deployable frame, a three-sided deployable frame, a zero-sided deployable frame [e.g., a circular deployable frame, an ovoid deployable frame, or the like], and/or the like). According to various aspects, each frame segment may be a hollow tube frame segment (e.g., of circular or non-circular cross-section). The deployable frame 202A may comprise a first frame segment 402 (e.g., one piece), a second frame segment 404 (e.g., two pieces), a third frame segment 406 (e.g., four pieces), and a fourth frame segment 408 (e.g., one piece). Each frame segment (e.g., 402, 404, 406, 408, and/or the like) may include a first end and a second end. According to various aspects described herein, the first end of each frame segment may include a male connector end or a female connector end and the second end of each frame segment may include a male connector end or a female connector end. In such aspects, a male connector end of a given frame segment is configured (e.g., sized, dimensioned, and/or the like) to couple with a female connector end of an adjacent frame segment and a female connector end of the given frame segment is configured (e.g., sized, dimensioned, and/or the like) to couple with a male connector end of an adjacent frame segment. According to aspects described herein, a male connector end may correspond to a first diameter tube (e.g., FIG. 4D, "d1") and the female connector end may correspond to a second diameter tube (e.g., FIG. 4D, "d2") and a frame segment body may correspond to a third diameter tube (e.g., FIG. 4D, "d3"). In one aspect, each male connector end includes a 5 mm diameter tube and each female connector end includes a 7 mm diameter tube. In some aspects, the first end and/or second end of a given frame segment may not include a separate female connector end. Namely, the female connector end may correspond to a diameter of the tubing used ("d2" may equal "d3", e.g., 7 mm diameter tubing) to form the deployable frame 202A (e.g., no separate connector end). In such aspects, a given frame segment may have only one separate connector end (one male connector end, e.g., third frame segment 406), two separate connector ends (e.g., two male connector ends, e.g., first frame segment 402, fourth frame segment 408), or no separate connector end (two female connector ends, e.g., second frame segment 404). In other aspects, the female connector end may correspond to a diameter greater than the diameter of the tubing used to form the deployable frame ("d2" greater than "d3"). According to yet further aspects of the present disclosure, at least one of the first end or the second end of each frame segment (e.g., 402, 404, 406, 408, and/or the like) may include a sleeve connector (not shown) corresponding (e.g., sized, dimensioned, or the like) to a diameter of the first end or the second end respectively and extending from each frame segment. In such aspects, each sleeve connector may be configured to couple a given frame segment to an adjacent frame segment. In various aspects, a sleeve connector may couple a given frame segment to an adjacent frame segment at a corner (e.g., sleeve connector defines the corner of the frame 202A). Further in such aspects, each sleeve connector may include a locking mechanism that not only affixes the sleeve connector to the first end or the second end respectively, but also releasably couples a given frame segment to an adjacent frame segment. In some aspects, the locking mechanism may include a spring loaded locking device. In one aspect, for example, a first sleeve connector associated with a given frame segment may include a spring loaded locking protrusion and a second, mating sleeve connector associated with an adjacent frame segment may include at least one hole defined therein. In such an aspect, a spring within the first sleeve connector may allow its locking protrusion to be selectively translated in and out of a hole defined in the first sleeve connector such that the first sleeve connector is insertable within the second, mating sleeve connector and the locking protrusion is selectively translatable in and out of the at least one hole defined in the second, mating sleeve connector to releasably lock the given frame segment to the adjacent frame segment. According to still further aspects of the present disclosure, at least one of the first end or the second end of each frame segment (e.g., 402, 404, 406, 408, and/or the like) may include a hinge to couple a given frame segment to an adjacent frame segment. In such aspects, each hinge may swing to lock to couple the plurality of frame segments to form the frame 202A in the deployed state and each hinge may swing to unlock to decouple the plurality of frame segments to a collapsed state. Further in such aspects, one or more than one of the hinges may be selectively separated to render the plurality of frame segments in a further collapsed state. According to yet other aspects, each frame segment (e.g., 402, 404, 406, 408, and/or the like) may be collapsible within one another (e.g., telescoping frame segments). In such aspects, the plurality of frame segments may be telescoped out and a first end of the telescoped segments may be coupled to a second end of the telescoped segments to form the frame 202A in the deployed state and the first end of the telescoped segments may be decoupled from the second end of the telescoped segments and the plurality of frame segments may be telescoped in to render the plurality of frame segments in a collapsed state. According to the various aspects described herein, the frame 202A may be formed from a metal, a metal alloy, a fiber-reinforced polymer, and/or the like. In one aspect, for example, the frame 202A may be formed from aluminum.

Figure 4B:
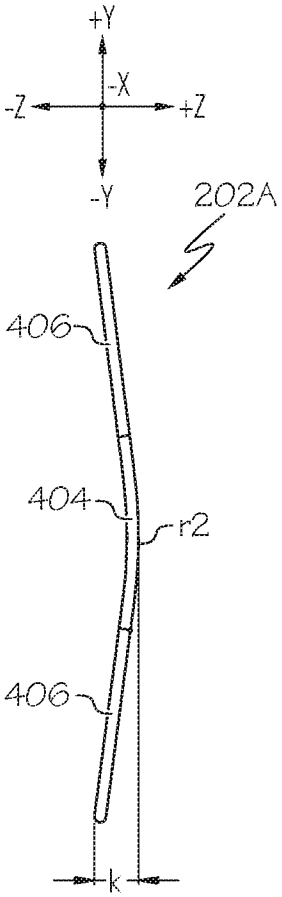
FIG. 4B depicts a side view of the illustrative deployable frame of FIG. 4A, according to one or more embodiments shown and described herein.

FIG. 4B depicts a side view of the illustrative deployable frame 202A of FIG. 4A. Referring to FIG. 4B, the second frame segment 404 may include a predefined curvature "r2". In such an aspect, the frame 202A may include a predetermined bowed or curved state due to the predefined curvature "r2". According to various aspects the curvature "r2" may cause a deflection "k" as depicted in FIG. 4B (e.g., in the +z direction of the coordinate axes of FIG. 4B). When the deployable frame 202A is positioned within the carrier portion 102A, the deflection "k" may create air-flow for comfort and/or create a structure to maintain a separation between the backpack portion 104A and the backpack user (e.g., such that object(s) in the backpack portion 104A cannot poke the backpack user in the back). In one aspect, for example, the deflection "k" may be about 4 cm. According to various aspects, the first end 414 of each third frame segment 406 may include an alignment feature (e.g., a notch) that interfaces with an alignment feature (e.g., protrusion) on each end of each second frame segment 404 to avoid twisting and to maintain the bowed or curved state of the deployable frame in the deployed state as depicted in FIG. 4B.

Figure 4C:
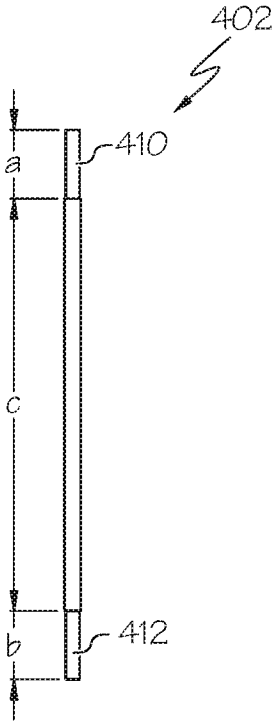
FIG. 4C depicts an illustrative frame segment of the deployable frame of FIG. 4A, according to one or more embodiments shown and described herein.

FIG. 4C depicts an illustrative first frame segment 402 of the deployable frame 202A of FIG. 4A. Referring to FIG. 4C, the first frame segment 402 includes a first end 410 having a male connector end and a second end 412 having a male connector end. According to various aspects each of the length "a" of the first end 410 and the length "b" of the second end 412 may correspond to a length associated with suitable fixation strength. In one aspect, for example, each of the length "a" and the length "b" may be about 2.5 cm. The length "c" of the first frame segment 402 may correspond to a length associated with the shoulder area of a backpack user (e.g., average width between shoulder blades, and/or the like). In one aspect, for example, the length "c" may be about 12 cm.

Figure 4D:
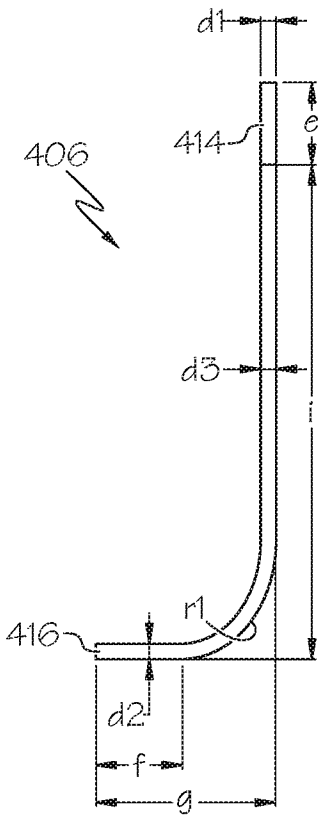
FIG. 4D depicts another illustrative frame segment of the deployable frame of FIG. 4A, according to one or more embodiments shown and described herein.

FIG. 4D depicts an illustrative third frame segment 406 of the deployable frame 202A of FIG. 4A. Referring to FIG. 4D, the third frame segment 406 may include a first end 414 having a male connector end and a second end 416 having a female connector end (e.g., corresponding to the diameter of the tubing itself). Similar to above, the length "e" of the first end 414 and the length "f" of the second end 416 may correspond to a length associated with suitable fixation strength (e.g., about 2.5 cm). In view of FIG. 4D, each third frame segment 406 may include a curvature "r1" to define the corners of the deployable frame 202A. In one aspect, the curvature "r1" may be about 4 cm. The length "g" may correspond to a length that, when doubled and added to length "c" (e.g., FIG. 4A) corresponds to a length associated with the shoulder area of a backpack user (e.g., average shoulder width and/or the like) and/or when doubled and added to a length "h" (e.g., FIG. 4A) corresponds to a length associated with the hip area of a backpack user (e.g., average hip width and/or the like). In one aspect, for example, the length "g" may be about 6.5 cm, the length "c" may be about 12 cm, and the length "h" may be about 10 cm. Accordingly, in such an aspect (e.g., in light of FIG. 4A), the length associated with the shoulder area of a backpack user may be about 25 cm (e.g., length "g" equal to about 6.5 cm, plus length "c" equal to about 12 cm, plus length "g" equal to about 6.5 cm) and the length associated with the hip area of the backpack user may be about 23 cm (e.g., length "g" equal to about 6.5 cm, plus length "h" equal to about 10 cm, plus length "g" equal to about 6.5 cm). Similarly, the length "i" may correspond to a length that, when doubled and added to a length "j" corresponds to a length associated with a back length of the backpack user (e.g. average back length and/or the like). In one aspect, for example, the length "i" may be about 15 cm and the length "j" may be about 15 cm. Accordingly, in such an aspect, (e.g., in light of FIG. 4A), the length associated with the back length of the backpack user may be about 45 cm (e.g., length "i" equal to about 15 cm, plus length "j" equal to about 15 cm, plus length "i" equal to about 15 cm).

In some aspects, referring briefly to FIG. 2, where the second frame segment 404 includes a predefined curvature "r2" (e.g., FIG. 4B), the upper pocket 206 and lower pocket 208 of the frame cavity 204 may constrain the frame 202A without causing the frame 202A to deflect to a bowed or curved state. In other aspects, where the second frame segment 404 includes the predefined curvature "r2", the upper pocket 206 and lower pocket 208 of the frame cavity 204 may not only constrain the frame 202A but also cause the frame 202A to deflect to a further bowed or curved state. Similarly, in light of FIG. 2, where the second frame segment 404 includes the predefined curvature "r2", the posterior middle section 210A and/or the anterior middle section 210B may not be configured to cause the frame 202A to deflect to a bowed or curved state, as described herein. In other aspects, where the second frame segment 404 includes the predefined curvature "r2", the posterior middle section 210A and/or the anterior middle section 210B may be configured to cause the frame 202A to deflect to a further bowed or curved state.

Referring to FIG. 4A in light of FIG. 1, each backpack system 100 may include a backpack portion 104A and a carrier portion 102A having the frame 202A. According to aspects described herein, the frame 202A may be configured to be deployed when in use and collapsible when not in use. In such aspects, when in a deployed state (e.g., in use), each end of each frame segment may be quickly and removably coupled to its adjacent frame segments to form an overall rigid or semi-rigid frame 202A (e.g., via male connector ends and/or female connector ends, as described herein). Further in such aspects, when in a collapsed state (e.g., not in use), each end of each frame segment may be quickly decoupled from its adjacent frame segments to form a collection of frame segments. In some aspects, each end of each frame segment may be uniquely identified (e.g., numbers, letters and/or the like stamped, engraved and/or the like on each end) for a backpack user to appropriately couple matching identifiers to form the rigid or semi-rigid frame 202A. In other aspects, each end of each frame segment may be maintained (e.g., when in a deployed state and when in a collapsed state) in association with its appropriate adjacent frame segment via a rope or cord threaded through each hollow tube frame segment. In some aspects, the rope or cord may be longer than, shorter than, or equal in length to a combined length of the frame segments when coupled together (e.g., in the deployed state). According to aspects described herein, the rope or cord may be an elastic rope or cord (e.g., bungee cord or shock cord) that is shorter in length than the combined length of the frame segments when coupled together such that a tensile force is generated within the rope or cord to keep the ends the plurality of frame segments coupled together in the deployed state. As described herein, according to various aspects, each frame segment may be a hollow tube having at least one diameter (e.g., FIG. 4D, "d1" for male connector ends, "d2" for female connector ends, "d3" for frame segment body, and/or the like). Accordingly, the rope or cord may have a diameter "d0" (e.g., FIG. 5B) less than "d1", "d2", and/or "d3" (e.g., FIG. 4D). In some aspects, "d0" may be a diameter that permits a knot to be formed within any frame segment (e.g., fourth frame segment 408). In one aspect, for example, the diameter "d0" of the rope or cord may be 2 mm.

Figure 5C:
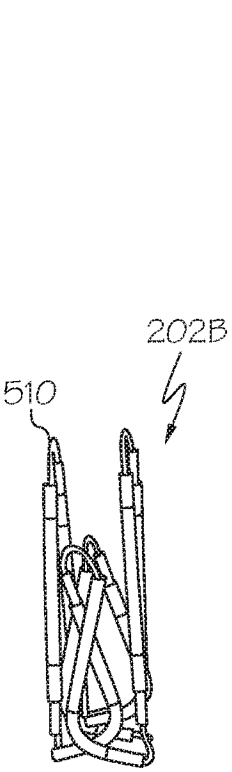
FIG. 5C depicts a perspective view of the deployable frame of FIG. 5A in a collapsed state, according to one or more embodiments shown and described herein.
Figure 5B:
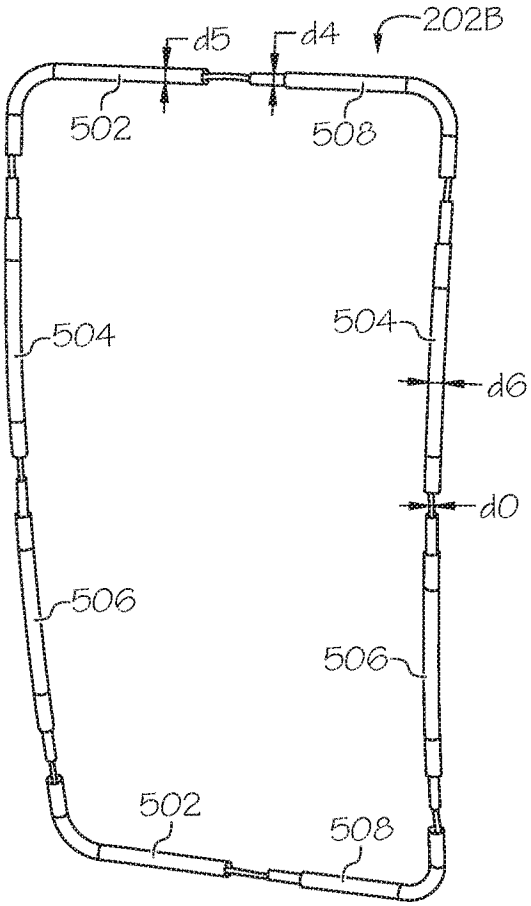
FIG. 5B depicts an exploded view of the deployable frame of FIG. 5A, according to one or more embodiments shown and described herein.
Figure 5A:
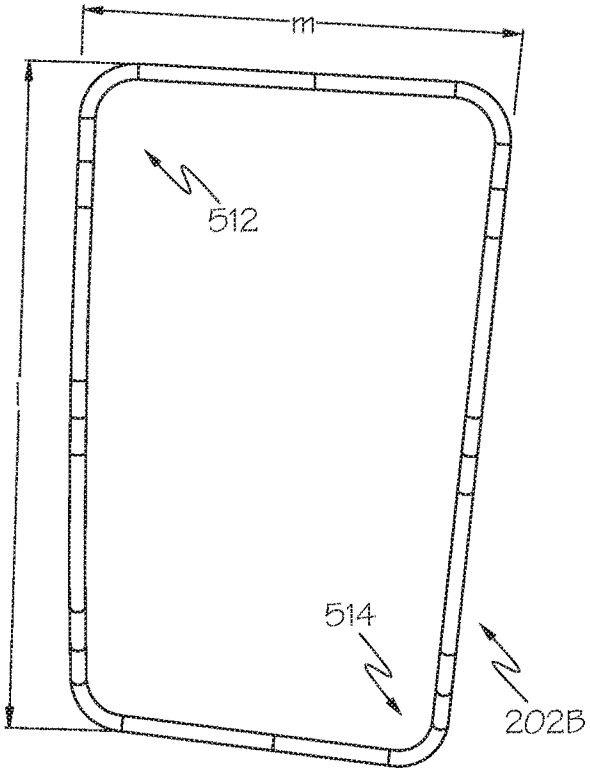
FIG. 5A depicts a perspective view of another illustrative deployable frame of the carrier portion of FIG. 1, according to one or more embodiments shown and described herein.

FIG. 5A depicts a perspective view of another illustrative deployable frame 202B of the carrier portion 102A of FIG. 1, according to various aspects of the present disclosure. Referring to FIG. 5A, similar to the deployable frame 202A of FIGS. 4A-4D, a plurality of frame segments may be coupled to form one continuous deployable frame 202B. FIG. 5B depicts an exploded view of the deployable frame 202B of FIG. 5A, according to various aspects of the present disclosure. Referring to FIG. 5B, for example, the deployable frame 202B may comprise a fifth frame segment 502 (e.g., two pieces), a sixth frame segment 504 (e.g., two pieces), a seventh frame segment 506 (e.g., two pieces), and an eighth frame segment 508 (e.g., two pieces). Similar to as described herein, each frame segment (e.g., 502, 504, 506, 508, and/or the like) may include a first end including a male connector or a female connector and a second end including a male connector or a female connector, where a male connector end of a given frame segment is configured (e.g., sized, dimensioned, and/or the like) to couple with a female connector end of an adjacent frame segment and a female connector end of the given frame segment is configured (e.g., sized, dimensioned, and/or the like) to couple with a male connector end of an adjacent frame segment. Still further, and similar to as described herein, each frame segment (e.g., 502, 504, 506, 508, and/or the like) may be coupled via sleeve connectors, hinges and/or telescoping frame segments to form the frame 202B.

Referring to FIG. 5B, according to aspects described herein, each male connector end may correspond to a first diameter tube (e.g., "d4") and each female connector end may correspond to a second diameter tube (e.g., "d5") and a frame segment body may correspond to a third diameter tube (e.g., "d6"). In one aspect, each male connector end includes a 5 mm diameter tube and each female connector end includes a 7 mm diameter tube. In some aspects, the first end and/or second end of a given frame segment may not include a separate female connector end. Namely, the female connector end may correspond to a diameter of the tubing used ("d5" may equal "d6", e.g., 7 mm diameter tubing) to form the deployable frame 202B (e.g., no separate connector end). In such aspects, a given frame segment may have only one separate connector end (e.g., one male connector end, sixth frame segment 504, eighth frame segment 508), two separate connector ends (e.g., two male connector ends, seventh frame segment 506), or no separate connector end (e.g., two female connector ends, fifth frame segment 502). In other aspects, the female connector end may correspond to a diameter greater than the diameter of the tubing used to form the deployable frame ("d5" greater than "d6").

Similar to as described herein, the first end and the second end of each frame segment (e.g., 502, 504, 506, 508, and/or the like) may have a length associated with suitable fixation strength. In one aspect, for example, the length of the first end and/or the second end may be about 2.5 cm. Furthermore, similar to as described herein, the overall length "l" (e.g. FIG. 5A) may correspond to a length associated with a back length of a backpack user (e.g., average back length and/or the like) and the overall length "m" (e.g., FIG. 5A) may correspond to a length associated with the shoulder area of a backpack user (e.g., average shoulder width and/or the like), a length associated with the hip area of a backpack user (e.g. average hip width and/or the like), or a length there between. In various aspects, the length "m" may be the same at an upper frame portion 512 and a lower frame portion 514 (e.g., FIG. 5A). In one aspect, for example, the length "l" may be about 45 cm and the length "m" may be about 25 cm, about 23 cm, or a length between about 23 cm and about 25 cm.

In light of FIG. 5A, the deployable frame 202B may not include a frame segment having a predefined curvature (See e.g., "r2" of second frame segment 404 of FIG. 4B). Accordingly, the deployable frame 202B may not include a predetermined bowed or curved state when not inserted within the carrier portion 102A. In such an aspect, referring briefly to FIG. 2, the upper pocket 206 and lower pocket 208 of the frame cavity 204 may not just constrain the frame 202B but also cause the frame 202B to deflect to a bowed or curved state. Similarly, the posterior middle section 210A and/or the anterior middle section 210B may be configured to cause the frame 202B to deflect to a further bowed or curved state, as described herein.

Referring to FIG. 5A in light of FIG. 1, each backpack system 100 may include a backpack portion 104A and a carrier portion 102A having the frame 202B. According to aspects described herein, the frame 202B may be configured to be deployed when in use and collapsible when not in use. In such aspects, when in a deployed state (e.g., in use), each end of each frame segment may be removably coupled to its adjacent frame segments to form an overall rigid or semi-rigid frame 202B (e.g., via male connector ends and/or female connector ends, as described herein). Further in such aspects, when in a collapsed state (e.g., not in use), each end of each frame segment may be decoupled from its adjacent frame segments to form a collection of frame segments. FIG. 5C depicts a perspective view of the deployable frame 202B of FIG. 5A in a collapsed state, according to various aspects of the present disclosure. Referring to FIG. 5C, the frame 202B, in its collapsed state, is more easily stowable than the frame 202B, in its deployed state, since it requires less storage volume in its collapsed state. In some aspects, the storage volume in its collapsed state may be similar in size to an umbrella. In light of FIG. 5B, each end of each frame segment may be maintained (e.g., when in a deployed state and when in a collapsed state) in association with its appropriate adjacent frame segment via a rope or cord 510 threaded through the plurality of hollow tube frame segment of the frame 202B. In some aspects, the rope or cord 510 may be longer than, shorter than, or equal in length to a combined length of the frame segments when coupled together (e.g., in the deployed state). According to aspects described herein, the rope or cord 510 may be an elastic rope or cord (e.g., bungee cord or shock cord) that is shorter in length than the combined length of the frame segments when coupled together such that a tensile force is generated within the rope or cord 510 to keep the ends the plurality of frame segments coupled together in the deployed state. As described herein, according to various aspects, each frame segment may be a hollow tube having at least one diameter (e.g., FIG. 5B, "d4" for male connector ends, "d5" for female connector ends, "d6" for frame segment body, and/or the like). Accordingly, the rope or cord 510 may have a diameter "d0" (FIG. 5B) less than "d4", "d5", and/or "d6". In some aspects, "d0" may be a diameter that permits a knot to be formed within any frame segment. In one aspect, for example, the diameter "d0" of the rope or cord 510 may be 2 mm.

Figure 6C:
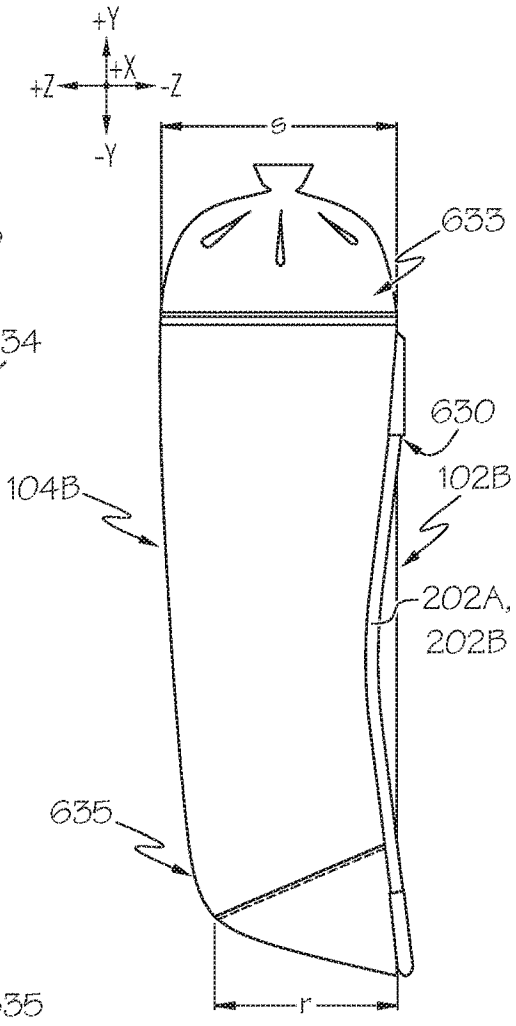
FIG. 6C depicts a side view of the backpack portion of FIG. 6B when coupled to the carrier portion of FIG. 6A, according to one or more embodiments shown and described herein.
Figure 6B:
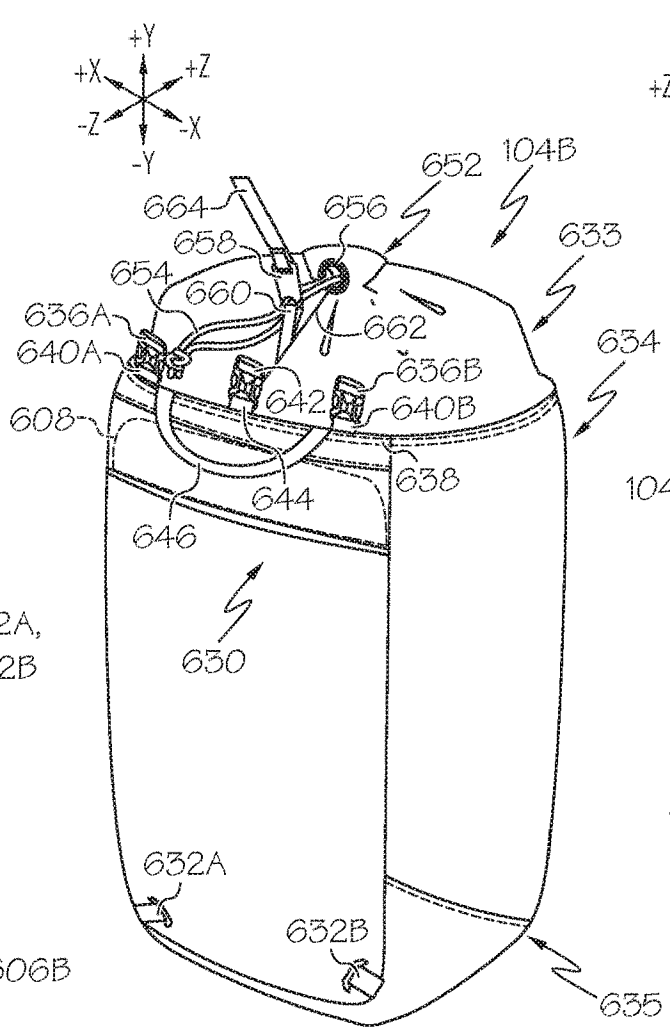
FIG. 6B depicts a back perspective view of another illustrative backpack portion, according to one or more embodiments shown and described herein.
Figure 6A:
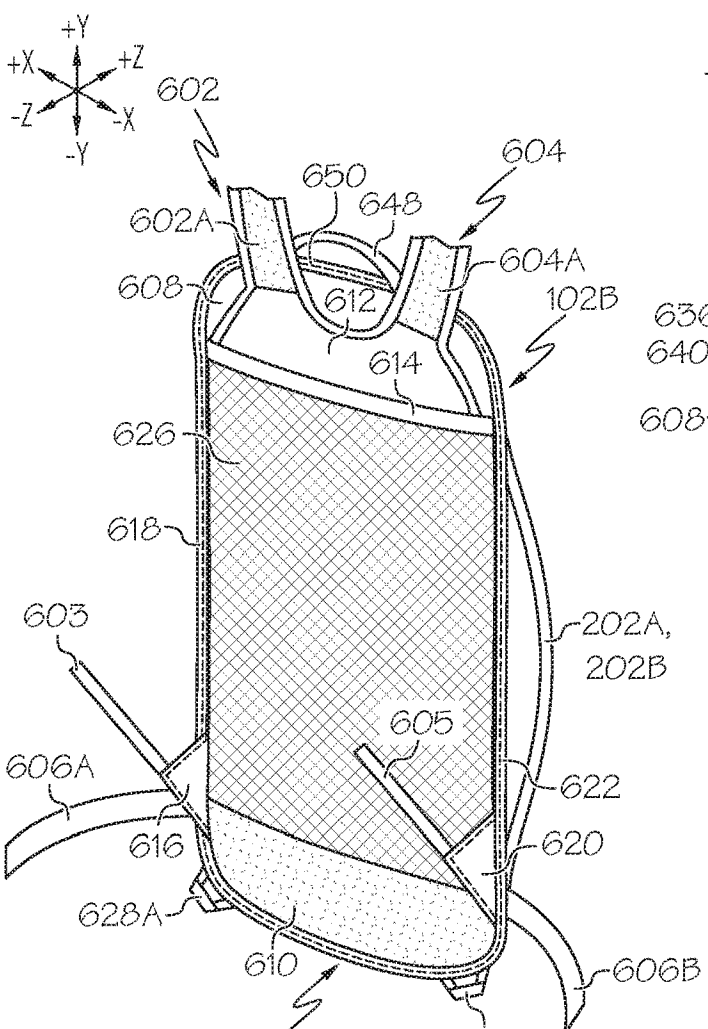
FIG. 6A depicts a back perspective view of another illustrative carrier portion, according to one or more embodiments shown and described herein.

FIG. 6A depicts a back perspective view of another illustrative carrier portion 102B, according to one or more aspects of the present disclosure. Referring to FIG. 6A, the carrier portion 102B may include a right shoulder strap 602, a left shoulder strap 604, a right waist belt portion 606A, and a left waist belt portion 606B (only a portion of the right shoulder strap 602, the left shoulder strap 604, the right waist belt portion 606A, and the left waist belt portion 606B are depicted in FIG. 6A). Each of the right shoulder strap 602 and the left shoulder strap 604 may include a first end 602A, 604A that fixedly attaches to an upper part 608 (e.g., in the +y direction of the coordinate axes of FIG. 6A) of the carrier portion 102B and a second end 602B, 604B (FIG. 7D) that couples to a lower part 610 (e.g., in the −y direction of the coordinate axes of FIG. 6A) of the carrier portion 102B. Referring to FIG. 6A, according to various aspects, the first end 602A of the right shoulder strap 602 and the first end 604A of the left shoulder strap 604 may fixedly attach to a yoke 612 that fixedly attaches to a seam 614 defined on a lower end (e.g., in the −y direction of the coordinate axes of FIG. 6A) of the upper part 608 of the carrier portion 102B. According to various aspects, seams as described herein, may not use seam tape. The second end 602B (FIG. 7D) of the right shoulder strap 602 may couple, via a right shoulder strap connector 603, to a right hip flap 616 that fixedly attaches to a seam 618 defined on a right side (e.g., in the +x direction of the coordinate axes of FIG. 6A) of the carrier portion 102B and the second end 604B (FIG. 7D) of the left shoulder strap 604 may couple, via a left shoulder strap connector 605, to a left hip flap 620 that fixedly attaches to a seam 622 defined on a left side (e.g., in the −x direction of the coordinate axes of FIG. 6A) of the carrier portion 102B. The carrier portion 102B, in some aspects, may include a handle 648 fixedly attached to seam 650 defined on a top side (e.g., in the +y direction of the coordinate axes of FIG. 6A) of the carrier portion 102B. The handle 648 may be usable to carry the carrier portion 102B (e.g., by itself) and/or the carrier portion 102B and the backpack portion 104B (e.g., when the backpack portion 104B is releasably coupled or secured to the carrier portion 102B). In one aspect, for example, the handle 648 may be a 20 mm nylon binding tape carry handle. According to various aspects, the seam 618, the seam 622 and the seam 650 may be part of a seam 624 that extends around a perimeter of the carrier portion 102B.

Referring still to FIG. 6A, the upper part 608 of the carrier portion 102B may include a first material, the lower part 610 of the carrier portion 102B may include a second material, and the middle part 626 (e.g., in the −z direction of the coordinate axes of FIG. 6A relative the posterior middle section 210A) of the carrier portion 102B may include a third material. In some aspects the yoke 612, the right hip flap 616 and the left hip flap 620 may similarly include the first material. Furthermore, the first end 602A of the right shoulder strap 602 and the first end 604A of the left shoulder strap 604 may similarly include the second material. According to various aspects, the upper part 608, the lower part 610, the middle part 626, the right shoulder strap 602, and/or the left shoulder strap 604 may be padded.

Further in view of FIG. 6A, the lower part 610 of the carrier portion 102B may include one or more than one toggle loop 628A, 628B. Each toggle loop 628A, 628B may be configured to releasably hold a toggle 632A, 632B (FIG. 6B), as discussed herein.

FIG. 6B depicts a back perspective view of another illustrative backpack portion 104B, according to various aspects of the present disclosure. The backpack portion 104B, as depicted in FIG. 6B, is illustrative and may include further features such as zippered enclosures, snap enclosures, interior pockets, exterior pockets, water bottle holders, accessory holders, headphone ports, and/or the like. Referring to FIG. 6B, the backpack portion 104B may include a top section 633, an upper section 634, and a lower section 635. Referring to FIG. 6B, a sleeve 630 may be defined on the upper section 634 (e.g., in the +y direction of the coordinate axes of FIG. 6B) of a rear surface (e.g., in the −z direction of the coordinate axes of FIG. 6B) of the backpack portion 104B. According to aspects described herein, the sleeve 630 may be configured to fittingly receive the upper part 608 of the carrier portion 102B of FIG. 6A (e.g., depicted via phantom lines in FIG. 6B for purposes of illustration) to releasably secure the upper section 634 of the backpack portion 104B to the upper part 608 of the carrier portion 102B. According to various aspects, after inserting the upper part 608 of the carrier portion 102B into the sleeve 630 of the backpack portion 104B, one or more than one toggle 632A, 632B, fixedly attached to the lower section 635 (e.g., in the −y direction of the coordinate axes of FIG. 6B) of the rear surface (e.g., in the −z direction of the coordinate axes of FIG. 6B) of the backpack portion 104B, may be releasably inserted into one or more than one toggle loop 628A, 628B (FIG. 6A) defined on the carrier portion 102B to releasably secure the lower section 635 of the backpack portion 104B to the lower part 610 of the carrier portion 102B.

Referring still to FIG. 6B, the backpack portion 104B may further include a first right buckle element 636A and a first left buckle element 636B fixedly or adjustably attached to a seam 638 (e.g., double stitched) defined on a rear surface (e.g., in the −z direction of the coordinate axes of FIG. 6B) of the backpack portion 104B. The first right buckle element 636A may fixedly or adjustably attach to the seam 638 via a right connector strap 640A and the first left buckle element 636B may fixedly or adjustably attach to the seam 638 via a left connector strap 640B. The first right buckle element 636A may be located and configured to releasably couple to a second right buckle element (see FIG. 7E, 760A) coupled near the first end 602A of the right shoulder strap 602 and the first left buckle element 636B may be located and configured to releasably couple to a second left buckle element (see FIG. 7E, 760B) coupled near the first end 604A of the left shoulder strap 604. In one aspect, for example, the first right buckle element 636A and the second right buckle element 760A may be components of a 20 mm side release buckle and the first left buckle element 636B and the second left buckle element 760B may be components of a 20 mm side release buckle. Similarly, the backpack portion 104B may further include a first intermediate buckle element 642 fixedly or adjustably attached to the seam 638 via an intermediate connector strap 644. The first intermediate buckle element 642 may be located and configured to releasably couple to a second intermediate buckle element (not shown) fixedly or adjustably attached to the carrier portion 102B. The first intermediate buckle element 642 and the second intermediate buckle element may be components of a 20 mm side release buckle. In some aspects, the first right buckle element 636A, the first left buckle element 636B, and/or the first intermediate buckle element 642 may be located and configured for use by a backpack user to attach, via an accessory buckle element (e.g., removably insertable within first right buckle element 636A, the first left buckle element 636B, and/or the first intermediate buckle element 642) an accessory (e.g., climbing rope and/or the like) to the backpack portion 104B (e.g., when the backpack portion 104B is decoupled from the carrier portion 102B).

Still referring to FIG. 6B, the backpack portion 104B may further include a handle 646 fixedly attached to the seam 638 defined on the rear surface (e.g., in the −z direction of the coordinate axes of FIG. 6B) of the backpack portion 104B. The handle 646 may be located and configured for use by a backpack user when the backpack portion 104B is decoupled from the carrier portion 102B. Accordingly, the backpack portion 104B is configured for use by the backpack user without the carrier portion 102B. In one aspect, for example, the handle 646 may be a 20 mm nylon binding tape carry handle. In some aspects, in light of FIG. 6A, the handle 646 of the backpack portion 104B and/or the handle 648 of the carrier portion 102B may include an attachment mechanism (e.g., hook and loop strip) to removably couple the handle 646 and the handle 648 when the backpack portion 104B is removably coupled to or secured to the carrier portion 102B.

Further in view of FIG. 6B, an access end 652 of the backpack portion 104B may be opened and/or closed via a draw cord 654. The access end 652, as depicted in FIG. 6B, is merely illustrative. In some aspects, the access end 652 may be positioned in an alternative location of the backpack portion 104B (e.g., a side, a front, and/or the like). Referring to FIG. 6B, the draw cord 654 may be pulled out through an eyelet 656 to close the access end 652 and the draw cord 654 may be pulled in through the eyelet 656 to open the access end 652. According to various aspects, a cord lock 658 may be coupled to the backpack portion 104B via a cord lock connector strap 660 fixedly attached (e.g., sewn into) a split seam 662 located at an upper-back portion (e.g., in the +y direction and −z direction of the coordinate axes of FIG. 6B) of the backpack portion 104B. The cord lock 658 may include a pull string 664 configured to open the cord lock 658 to adjustably pull the draw cord 654 in through and/or out through the eyelet 656. In one aspect, for example, the draw cord 654 may be a 3 mm polypropylene cord, the eyelet 656 may be a 15 to 20 mm matte black eyelet in zinc alloy, the cord lock connector strap 660 may be a 10 mm nylon binding tape loop, and the pull string 664 may be a 10 mm nylon binding loop string. According to other aspects of the present disclosure, the access end 652 of the backpack portion 104B may be opened and/or closed via an enclosure mechanism other than a draw cord 654. In some aspects the enclosure mechanism may include a zipper, snaps, toggles, a roll-top and/or the like.

In light of FIGS. 6A and 6B, an illustrative process of coupling the backpack portion 104B and the carrier portion 102B is described. According to various aspects, the process of coupling the backpack portion 104B and the carrier portion 102B may include inserting the upper part 608 of the carrier portion 102B into the sleeve 630 of the backpack portion 104B. Further, the process of coupling the backpack portion 104B and the carrier portion 102B may include releasably inserting the first toggle 632A of the backpack portion 104B into the first toggle loop 628A of the carrier portion 102B and the second toggle 632B of the backback portion 104B into the second toggle loop 628B of the carrier portion 102B. According to various aspects described herein, releasably coupling the first toggle 632A to the first toggle loop 628A and the second toggle 632B to the second toggle loop 628 not only secures the lower section 635 of the backpack portion 104B to the lower part 610 of the carrier portion 102B (e.g., in the −z direction of the coordinate axes of FIG. 6B) but also generates a downward force (e.g., in the −y direction of the coordinate axes of FIG. 6B) to retain the upper part 608 of the carrier portion 102B within the sleeve 630 of the backpack portion 104B. In addition, releasably coupling the first toggle 632A to the first toggle loop 628A and the second toggle 632B to the second toggle loop 628 may distribute or redistribute a portion of a weight to be carried within the backpack portion 104B from the upper part 608 of the carrier portion 102B to the lower part 610 of the carrier portion 102B. Yet further, the process of coupling the backpack portion 104B and the carrier portion 102B may include releasably coupling the first right buckle element 636A of the backpack portion 104B to the second right buckle element (FIG. 7E, 760A) of the carrier portion 102B, the first left buckle element 636B of the backpack portion 104B to the second left buckle element (FIG. 7E, 760B) of the carrier portion 102B, and/or the first intermediate buckle element 642 to the second intermediate buckle element of the carrier portion 102B. Still further, the process of coupling the backpack portion 104B and the carrier portion 102B may include tensioning a right shoulder tensioner strap 762 (FIG. 7E) that adjustably couples the second right buckle element 760A (FIG. 7E) to the right shoulder strap 602 and a left shoulder tensioner strap 764 that adjustably couples the second left buckle element 760B (FIG. 7E) to the left shoulder strap 604 to distribute or redistribute a portion of the weight to be carried within the backpack portion 104B to the right shoulder strap 602 and/or the left shoulder strap 604, respectively. In some aspects, the tensioning may further include tensioning an intermediate shoulder tensioner strap (not shown) that adjustably couples the second intermediate buckle strap to the carrier portion 102B to draw the backpack portion 104B to the carrier portion and to distribute or redistribute a portion of the weight to be carried within the backpack portion 104B to the frame 202A, 202B.

FIG. 6C depicts a side view of the backpack portion 104B when coupled to the carrier portion 102B. Referring to FIG. 6C the frame 202A, 202B may be configured to control lateral (e.g., in the +x and/or −x direction of the coordinate axes of FIG. 6C) movement of the backpack portion 104B when coupled to the carrier portion 102B. More specifically, in view of FIG. 6C, the frame 202A, 202B in its deflected state may controllably interface with the sides (e.g., in the +x direction and/or −x direction of the coordinate axes of FIG. 6C) of the backpack portion 104B to impede lateral movement. Furthermore, in view of FIG. 6C, the carrier portion 102B is shown as inserted within the sleeve 630 of the backpack portion 104B. In FIG. 6C, various components of the carrier portion 102B (see FIG. 6A, e.g., right shoulder strap 602, left shoulder strap 604, right waist belt portion 606A, left waist belt portion 606B, and/or the like) have been removed for ease of illustration.

Figure 7A:
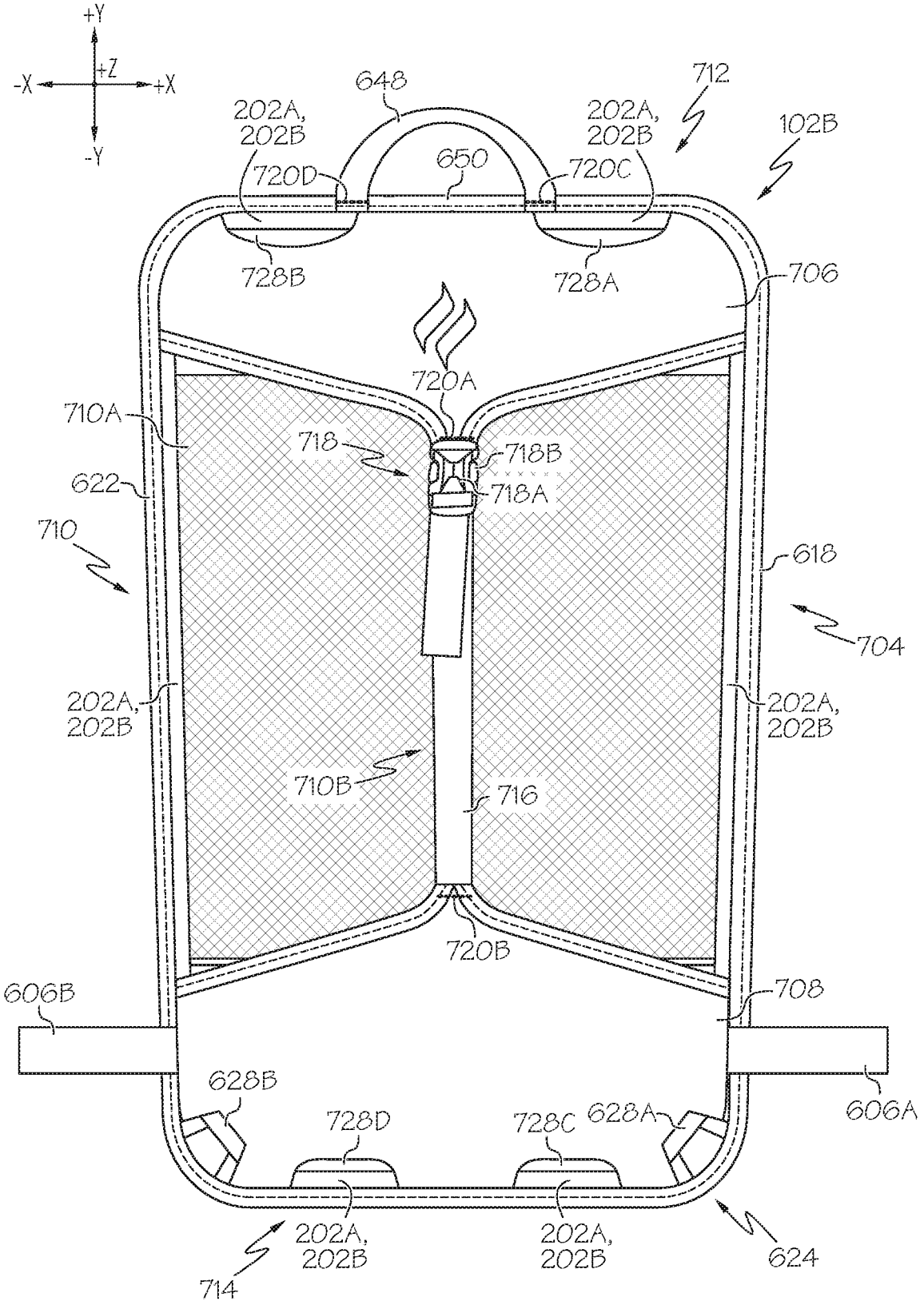
FIG. 7A depicts a front perspective view of the carrier portion of FIG. 6A, according to one or more embodiments shown and described herein.

FIGS. 7A-7E illustrate further details with respect to the carrier portion 102B of FIG. 6A. FIG. 7A depicts a front perspective view of the carrier portion 102B of FIG. 6A, according to various aspects described herein. Referring to FIG. 7A, the carrier portion 102B (e.g., similar to the carrier portion 102A of FIG. 2) may define a frame cavity 704 configured to constrain a deployable frame 202A, 202B (e.g., an aluminum frame) in its deployed state, as described herein. The frame cavity 704 may define an upper pocket 706 (e.g., positioned towards the +y direction of the coordinate axes of FIG. 7A) locatable about the shoulder area of a backpack user and a lower pocket 708 (e.g., positioned towards the −y direction of the coordinate axes of FIG. 7A) locatable about the hip area of the backpack user. Referring to FIG. 7A, the frame cavity 704 may be defined by at least one material. According to various aspects, the upper pocket 706 may be defined by a double layer of body fabric (e.g., to hold the frame 202A, 202B in place) and the lower pocket 708 may be defined by a single layer of body fabric with binding (e.g., to hold the frame 202A, 202B in place). In one aspect, for example, the upper pocket 706 and the lower pocket may be an N70D Ripstop Liongxiang (1.9 oz woven nylon) with WR C6 (fluorinated water repellent with 6 carbons in its perfluoroalkyl chain) and PU 2000 mm (polyurethane coated, waterproof rated to withstand a 2000 mm column of water over a designated time period before a single drop of water penetrates the material). A middle section 710 of the carrier portion 102B may connect the upper pocket 706 and the lower pocket 708.

Referring to FIG. 7A, the middle section 710 may include a posterior middle section 710A (e.g., positioned towards the −z direction of the coordinate axes of FIG. 7A) and an anterior middle section 710B (e.g., positioned towards the +z direction of the coordinate axes of FIG. 7A). The posterior middle section 710A may include a material that is the same as or different from the material of the upper pocket 706 and/or the lower pocket 708. According to various aspects, the posterior middle section 710A may be defined by an airmesh lumbar pad with a body fabric lining. In one aspect, for example, the posterior middle section 710A may be a strong nylon mesh that is soft to touch and see-through.

The anterior middle section 710B may include at least one strap configured to removably couple the upper pocket 706 and the lower pocket 708. In some aspects, the anterior middle section 710B may include a buckle 718 and a strap 716. In such aspects, the buckle 718 may include a first buckle element 718A and a second buckle element 718B. In one aspect, for example, the buckle 718 may be a 20 mm side release buckle. In view of FIG. 7A, the first buckle element 718A may be fixedly attached to the upper pocket 706 and the second buckle element 718B may be adjustably coupled, via the strap 716, to the lower pocket 708. More specifically, the strap 716 may include a first end fixedly attached to the lower pocket 708 and a second end adjustably coupled to the second buckle element 718B. The first buckle element 718A may be fixedly attached, via bar-tack 720A, to the upper pocket 706 and the first end of the strap 716 may be fixedly attached, via bar-tack 720B, to the lower pocket 708 for reinforcement. In one aspect, for example, the strap 716 may be a 20 mm nylon binding tape. Referring to FIG. 7, after the frame 202A, 202B is removably positioned within the upper pocket 706 and the lower pocket 708 of the frame cavity 704 and the second buckle element 718B is removably inserted within the first buckle element 718A, the second end of the strap 716 may be pulled (e.g., in a −y direction of the coordinate axes of FIG. 7A) to tighten the anterior middle section 710B to secure the frame 202A, 202B within the frame cavity and/or to modify the deflection amount of the frame 202A, 202B, as described herein.

Referring to FIG. 7A, according to various aspects, one or more than one upper access void 728A, 728B may be defined in the upper pocket 706 and one or more than one lower access void 728C, 728D may be defined in the lower pocket 708 of the carrier portion 102B. Each upper access void 728A, 728B may expose an upper frame portion 712 as positioned within the upper pocket 706 and each lower access void 728C, 728D may expose the lower frame portion 714 as positioned within the lower pocket 708. In such aspects, a same carrier portion 102B may be configured to accommodate more than one type of backpack portion (e.g., backpack portion 104B of FIG. 6B, backpack portion 104A of FIG. 1, and/or the like).

Referring still to FIG. 7A, the carrier portion 102B may further include one or more than one toggle loop 628A, 628B. Each toggle loop 628A, 628B may be configured to releasably hold one or more than one toggle 632A, 632B of the backpack portion 104B as described herein. In one aspect, for example, each toggle loop 628A, 628B may be a 10 mm nylon binding loop and each toggle 632A, 632B may be a Woojin Large Closing Bone 1086 (e.g., toggle for 15 mm wide nylon binding tape). In addition the carrier portion 102B may include a handle 648, a right waist belt portion 606A, and a left waist belt portion 606B as discussed herein. In some aspects, the handle 648 may be fixedly attached, via bar-tacks 720C, 720D, to the seam 650 for reinforcement. According to various aspects, the right waist belt portion 606A may include a first end fixedly coupled to the seam 618 of the carrier portion 102B and a second end adjustably coupled to a right waist buckle element of a waist buckle (not shown) and the left waist belt portion 606B may include a first end fixedly coupled to the seam 622 of the carrier portion 102B and a second end adjustably coupled to a left waist buckle element of the waist buckle (not shown). In one aspect, for example, each of the right waist belt portion 606A and the left waist belt portion 606B may be a 20 mm nylon binding tape and the waist buckle may be a 20 mm dual adjust side release buckle.

Figure 7C:
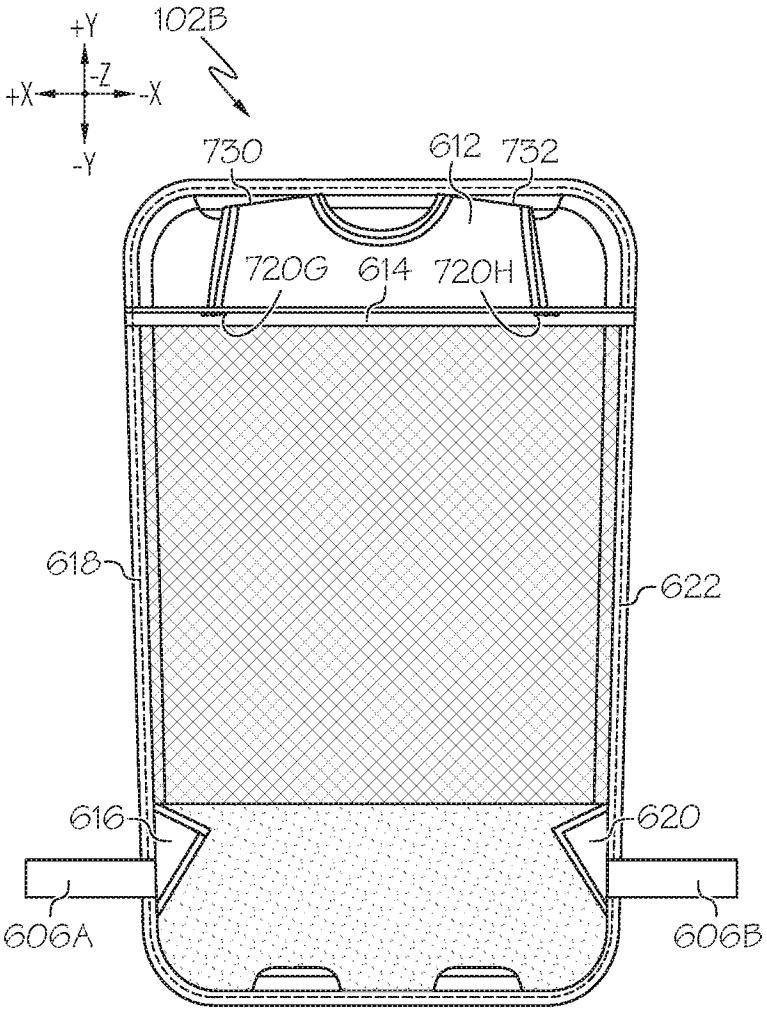
FIG. 7C depicts a back perspective view of the carrier portion of FIG. 6A including a yoke, a right hip flap, a right waist belt portion, a left hip flap, and a left waist belt portion, according to one or more embodiments shown and described herein.
Figure 7B:
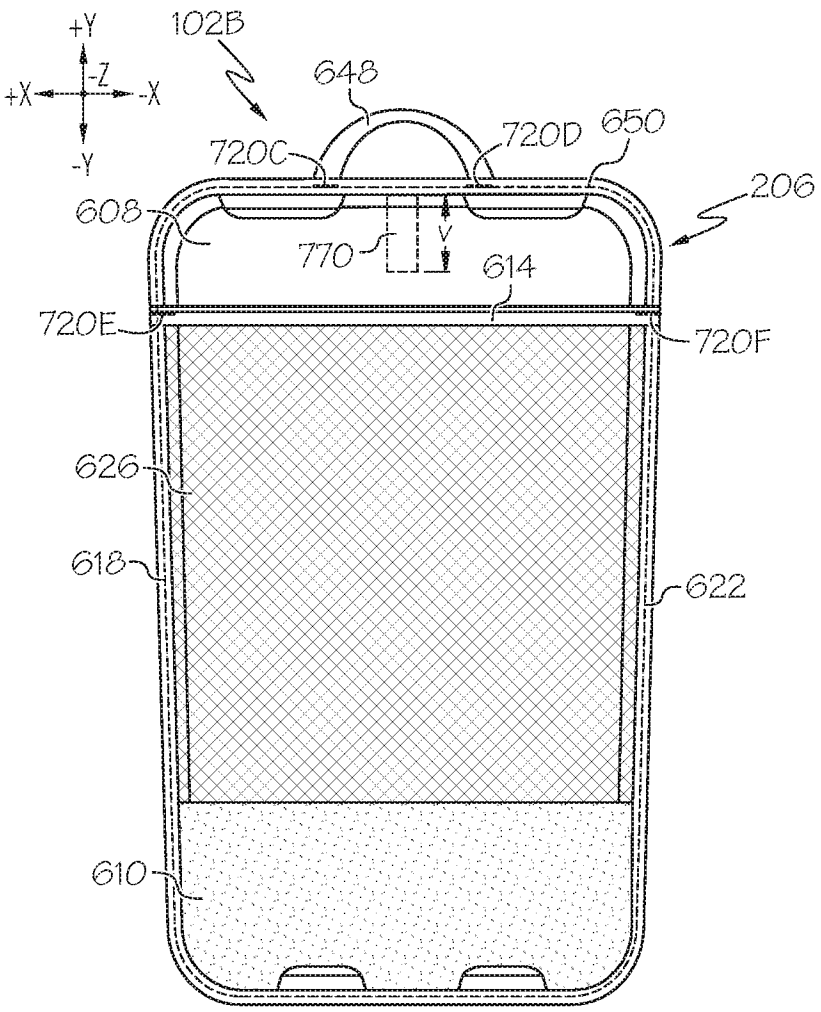
FIG. 7B depicts a back perspective view of the carrier portion of FIG. 6A, according to one or more embodiments shown and described herein.
Figure 7E:
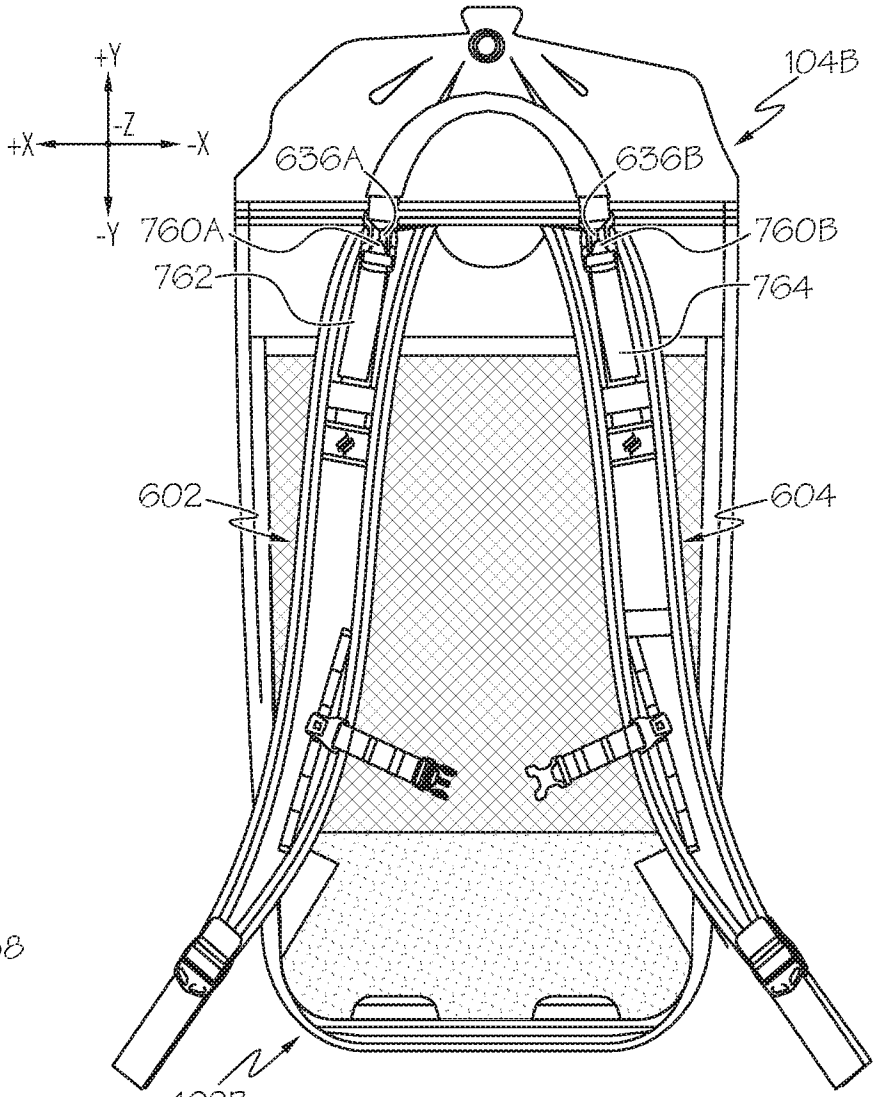
FIG. 7E depicts a back perspective view of the carrier portion of FIG. 6A releasably coupled to the backpack portion of FIG. 6B, according to one or more embodiments shown and described herein.
Figure 7D:
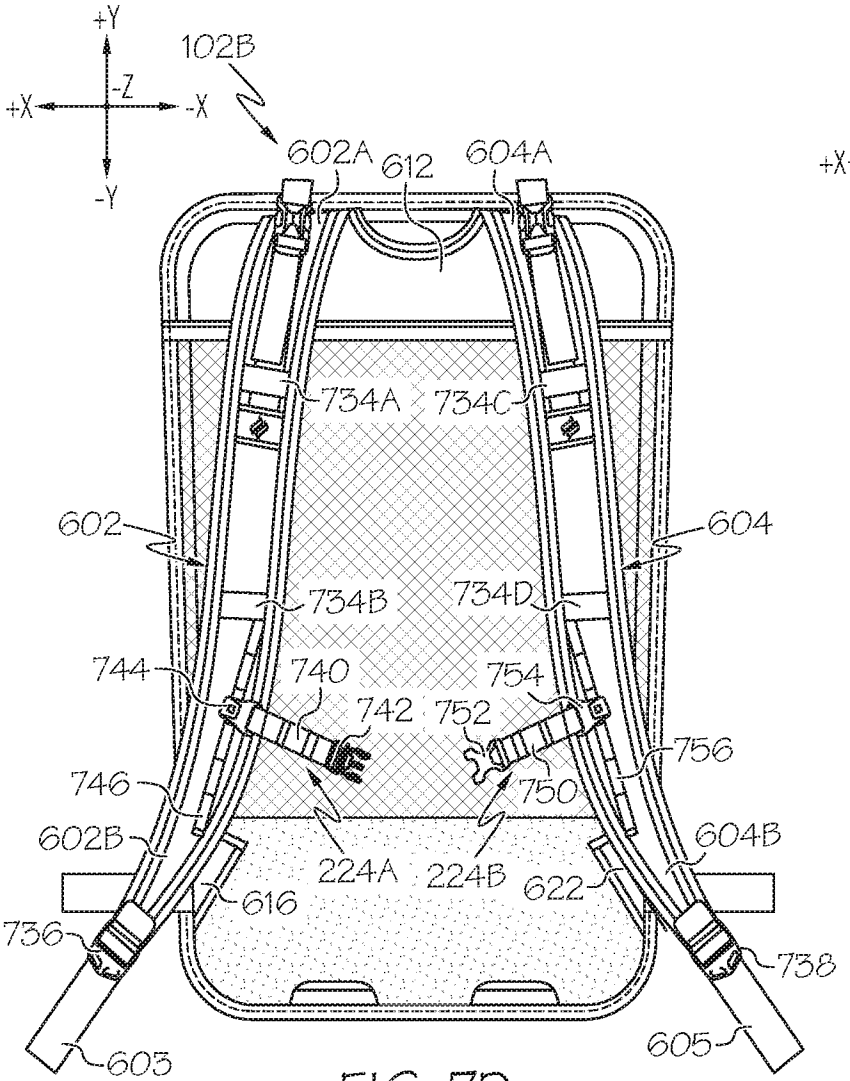
FIG. 7D depicts a back perspective view of the carrier portion of FIG. 6A including the a right shoulder strap and a left shoulder strap, according to one or more embodiments shown and described herein.

FIGS. 7B-7D depict progressing perspective views that illustrate a sequential addition of components to the carrier portion 102B of FIG. 6A.

FIG. 7B depicts a back perspective view (e.g., in the −z direction of the coordinate axes of FIG. 7B) of the carrier portion 102B of FIG. 6A, according to various aspects described herein. Referring to FIG. 7B, the upper part 608 of the carrier portion 102B may include a first material, the lower part 610 of the carrier portion 102B may include a second material, and the middle part 626 (e.g., in the +z direction of the coordinate axes of FIG. 7A relative the posterior middle section 710A) of the carrier portion 102B may include a third material. In one aspect, for example, the upper part 608 may be an N70D Ripstop Liongxiang with WR C6 and PU 2000 mm, the lower part 610 may be an airmesh, and the middle part 626 may be a large hole, strong nylon mesh that is non-stretch that is soft to touch and see-through. According to various aspects, the airmesh of the lower part 610 may not include a padding to minimize stowable or packing volume. Furthermore, in view of FIG. 7B, the handle 648 may be fixedly attached, via bar-tacks 720C, 720D, to the seam 650 defined on a top side (e.g., in the +y direction of the coordinate axes of FIG. 7A) of the carrier portion 102B for reinforcement. Similarly, the seam 614 defined on a lower end (e.g., in the −y direction of the coordinate axes of FIG. 7A) of the upper part 608 of the carrier portion 102B may be fixedly coupled, via bar-tack 720E, to the seam 618 defined on the right side (e.g., in the +x direction of the coordinate axes of FIG. 7A) of the carrier portion 102B for reinforcement and the seam 614 may be fixedly coupled, via bar-tack 720F, to the seam 622 defined on a left side (e.g., in the −x direction of the coordinate axes of FIG. 7A) of the carrier portion 102B for reinforcement. Further in view of FIG. 7B, in some aspects, a connector strip 770 may be fixedly attached to (e.g., sewn into) the seam 650 such that the connector strip 770 extends downward (e.g., in a −y direction of the coordinate axes of FIG. 7A) a length "v". In some aspects, the connector strip 770 may be fixedly attached to the seam 650 inside the upper pocket 206 of the carrier portion 102B. In one aspect, for example, the connector strip 770 may include a 20 mm hook and loop fastener (e.g., Velcro®) that extends downward about 6 cm. According to various aspects, the connector strip 770 may be configured and located to retain a water bladder (e.g., a water bladder handle).

FIG. 7C depicts a back perspective view of the carrier portion 102B of FIG. 6A further including the yoke 612, the right hip flap 616, the right waist belt portion 606A, the left hip flap 620, and the left waist belt portion 606B. In view of FIG. 7C, the yoke 612 may be fixedly attached (e.g., sewn into) to the seam 614. In some aspects, the yoke 612 may be further coupled to the seam 614, via bark-tack 720G and bar-tack 720H, for reinforcement. According to various aspects, the yoke 612 may define a right shoulder seam 730 and a left shoulder seam 732. Furthermore, the right hip flap 616 and the right waist belt portion 606A may be fixedly attached (e.g., sewn into) to the seam 618 and the left hip flap 620 and the left waist belt portion 606B may be fixedly attached (e.g., sewn into) to the seam 622.

FIG. 7D depicts a back perspective view of the carrier portion 102B further including the right shoulder strap 602 and the left shoulder strap 604. In light of FIG. 7C, the first end 602A of the right shoulder strap 602 may be fixedly attached (e.g., sewn into) to the right shoulder seam 730 of the yoke 612 and the first end 604A of the left shoulder strap 604 may be fixedly attached (e.g., sewn into) to the left shoulder seam 732 of the yoke 612. Furthermore, in light of FIG. 6A, the second end 602B of the right shoulder strap 602 may couple, via right shoulder strap connector 603, to the right hip flap 616 and the second end 604B of the left shoulder strap 604 may couple, via left shoulder strap connector 605, to a left hip flap 620. Referring still to FIG. 7D, the second end 602B of the right shoulder strap 602 may include a right strap buckle element 736 and the second end 604B of the left shoulder strap 604 may include a left strap buckle element 738. In such aspects, the right shoulder strap connector 603 may include a first end fixedly attached to the right hip flap 616 and a second end adjustably coupled to the right strap buckle element 736. Similarly, the left shoulder strap connector 605 may include a first end fixedly attached to the left hip flap 622 and a second end adjustably coupled to the left strap buckle element 738. Referring still to FIG. 7D, the right shoulder strap 602 may include an upper loop 734A and a lower loop 734B and the left shoulder strap 604 may include an upper loop 734C and a lower loop 734D. According to various aspects, each loop 734A, 734B, 734C, 734D may be located to restrain an accessory item (e.g., hydration bladder tube and/or the like). In one aspect, for example, each loop 734A, 734B, 734C, 734D may be a 20 mm elastic band loop.

Still referring to FIG. 7D, the right shoulder strap 602 may include a right chest strap portion 224A and the left shoulder strap 604 may include a left chest strap portion 224B. According to various aspects, the right chest strap portion 224A and the left chest strap portion 224B may be configured to releasably couple to form the chest strap 224 (e.g. FIG. 2). The right chest strap portion 224A may include right chest strap connector 740. A first end of the right chest strap connector 740 may adjustably couple to a right chest buckle element 742 and a second end of the right chest strap connector 740 may adjustably couple to a right slidable component 744. Similarly, the left chest strap portion 224B may include left chest strap connector 750. A first end of the left chest strap connector 750 may adjustably couple to a left chest buckle element 752 and a second end of the left chest strap connector 750 may adjustably couple to a left slidable component 754. According to various aspects, when the right chest buckle element 742 is releasably coupled with the left chest buckle element 752, the right slidable component 744 may translate along a right adjustment strap 746 and the left slidable component 754 may translate along a left adjustment strap 756 to comfortably position the chest trap 224 with respect to the backpack user's chest.

FIG. 7E depicts a back perspective view of the carrier portion 102B of FIG. 6A releasably coupled to the backpack portion 104B of FIG. 6B according to various aspects described herein. Referring to FIG. 7E, the first right buckle element 636A may releasably couple to a second right buckle element 760A coupled to the right shoulder strap 602 and the first left buckle element 636B may releasably couple to a second left buckle element 760B coupled to the left shoulder strap 604. In view of FIG. 7E, the second right buckle element 760A may couple, via right shoulder tensioner strap 762, to the right shoulder strap 602 and the second left buckle element 760B may couple, via left shoulder tensioner strap 764, to the left shoulder strap 604. Referring still to FIG. 7D, a first end of the right shoulder tensioner strap 762 may be fixedly attached to the right shoulder strap 602 and a second end of the right shoulder tensioner strap 762 may be adjustably coupled to the second right buckle element 760A. Similarly, a first end of the left shoulder tensioner strap 764 may be fixedly attached to the left shoulder strap 604 and a second end of the left shoulder tensioner strap 764 may be adjustably coupled to the second left buckle element 760B. According to various aspects described herein, after releasably coupling the first right buckle element 636A to the second right buckle element 760A and the first left buckle element 636B to the second left buckle element 760B, the second end of the right shoulder tensioner strap 762 and the second end of the left shoulder tensioner strap 764 may pulled (e.g., by the backpack user) to releasably secure the backpack portion 104B to the carrier portion 102B.

Figure 8B:
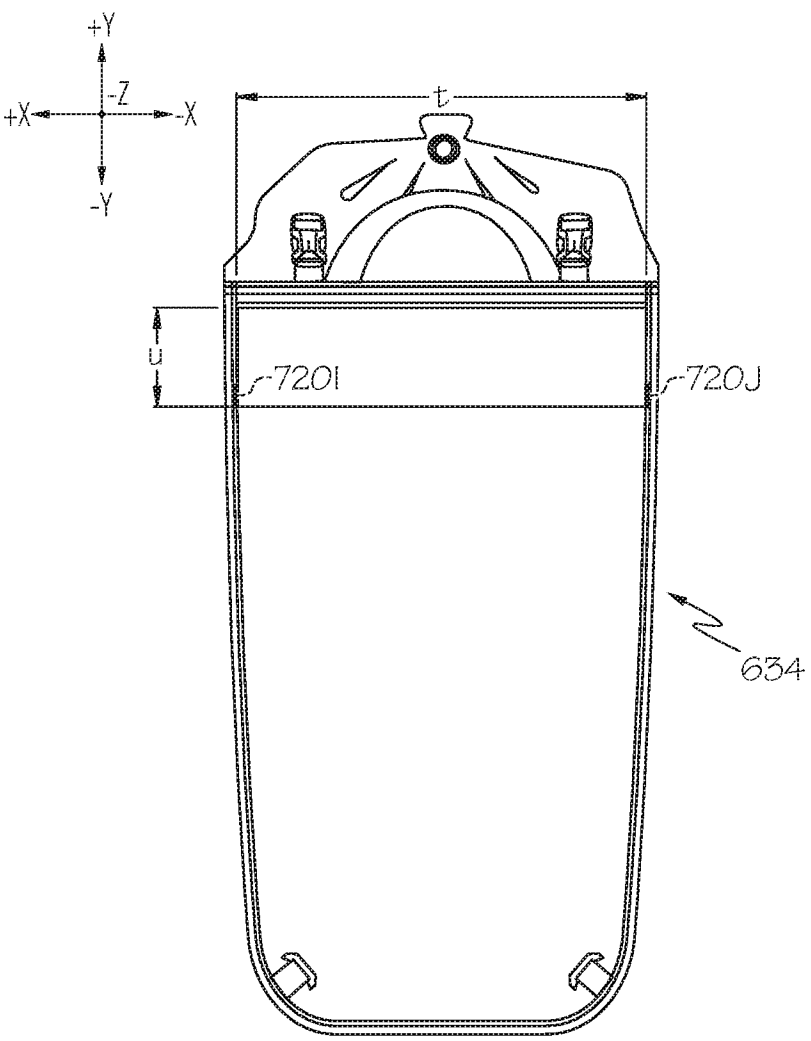
FIG. 8B depicts a back perspective view of the backpack portion of FIG. 6B, according to one or more embodiments shown and described herein.
Figure 8A:
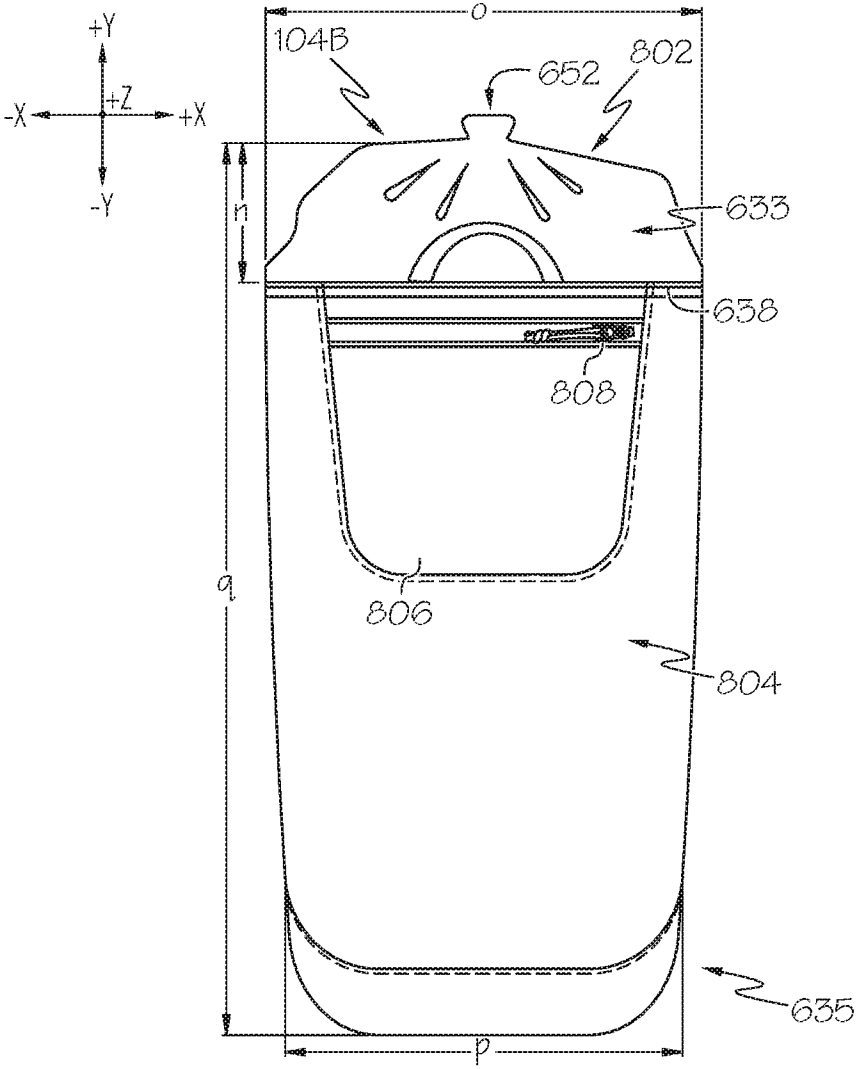
FIG. 8A depicts a front perspective view of the backpack portion of FIG. 6B, according to one or more embodiments shown and described herein.

FIG. 8A depicts a front perspective view of the backpack portion 104B of FIG. 6B, according to various aspects described herein. In various aspects, the backpack portion 104B may define a draw cord section 802 and a main body section 804. In some aspects, the draw cord section 802 and the main body section 804 may be defined by a first material. In other aspects, the draw cord section 802 and the main body section 804 may be defined by different materials. In one aspect, for example, the first material may by a N70D Ripstop Liongxiang with WR C6 and PU 2000 mm. In another aspect, for example, the first material may be a water-proof or water-resistant material. According to various aspects, a front portion (e.g., in the +z direction of the coordinate axes of FIG. 8A) of the main body section 804 may be defined with no or minimal seams. Referring to FIG. 8A, the backpack portion 104B may further define a front pouch 806. In some aspects, the front pouch 806 may be defined by the first material. In other aspects, the front pouch 806 may be defined by a material different from the first material. According to various aspects, the front pouch 806 may be closable via a closure mechanism 808. In some aspects, a material (e.g., first material or different material) may form a garage or cover for the closure mechanism 808. In one aspect, for example, the closure mechanism 808 may be about a 2.6 cm zip slider. In other aspects, the closure mechanism 808 may be a #5 YKK® (YKK Group, Tokyo, Japan) reversed zipper with short metal puller with a cord zip puller. Referring still to FIG. 8A, the access end 652 of the backpack portion 104B is depicted as closed. According to various aspects, when the backpack portion 104B is filled and the access end 652 is closed, the top section 633 (e.g., in the +y direction of the coordinate axes of FIG. 8A) of the backpack portion 104B may be a length "n" above the seam 638 (e.g., a double-stitch seam) defined on the front surface (e.g., in the +z direction of the coordinate axes of FIG. 8A) of the backpack portion 104B. In one aspect, for example, the length "n" may be about 8.5 cm. According to various aspect the top section 633 of the backpack portion 104B may be a width "o" and the lower section 635 (e.g., in the −y direction of the coordinate axes of FIG. 8A) of the backpack portion 104B may be a width "p" and the backpack portion 104B may be a length "q". In one aspect, for example, the width "o" may be about 26 cm, the width "p" may be about 24 cm, and the length "q" may be about 45 cm. Referring briefly to FIG. 6C, the lower section 635 (e.g., in the −y direction of the coordinate axes of FIG. 6C) of the backpack portion 104B may be angled to define a dynamic profile. According to various aspects the lower section 635 of the backpack portion 104B may be a depth "r" and the top section 633 of the backpack portion 104B may be a depth "s". In one aspect, for example, the depth "r" may be about 10 cm and the depth "s" may be about 16 cm.

FIG. 8B depicts a back perspective view of the backpack portion of FIG. 6B, according to various aspects described herein. Referring to FIG. 8B, as discussed herein, the sleeve 630 may be defined on the upper section 634 (e.g., in the +y direction of the coordinate axes of FIG. 8B) of a rear surface (e.g., in the −z direction of the coordinate axes of FIG. 8B) of the backpack portion 104B. As described herein, the sleeve 630 may be sized and configured to fittingly receive the upper part 608 of the carrier portion 102B of FIG. 6A. According to various aspects, the sleeve 630 may have a width "t" and a length "u". In one aspect, for example, the width "t" may be about 26 cm and the length "u" may be about 6 cm. In other aspects, the width "t" may correspond to the length "m" (e.g., FIG. 5A) and/or a sum of the lengths "g", "c", and "g" (e.g., FIG. 4A) such that the deployable frame 202A, 202B realizes a tight or interference fit within the sleeve 630. According to various aspects, the sleeve 630 may be defined by a double layer of a first material. In one aspect, for example, the first material may be N70D Ripstop Liongxiang with WR C6 and PU 2000 mm. In some aspects, bar-tacks 7201, 7201 may be added to reinforce the open end of the sleeve 630.

Figure 9D:
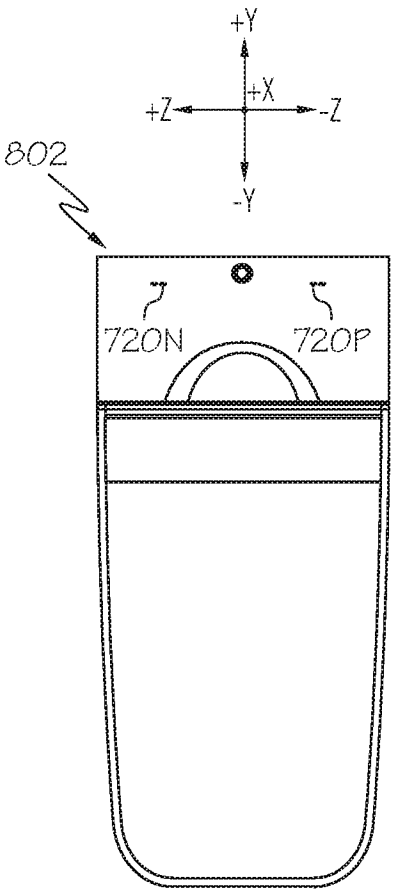
FIG. 9D depicts a back perspective view of the draw cord section of the backpack portion of FIG. 6B, prior to defining the draw cord tunnel of FIG. 9A, according to one or more embodiments shown and described herein.
Figure 9C:
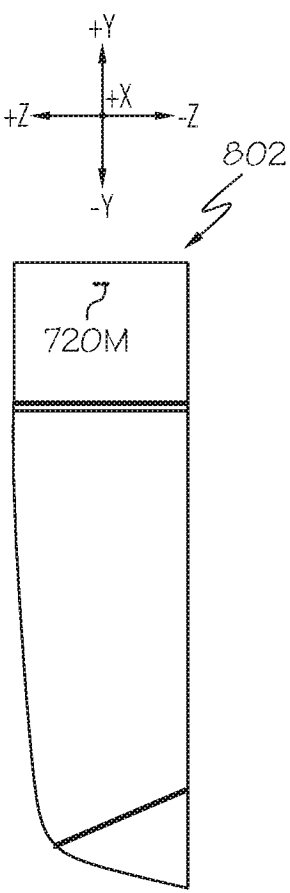
FIG. 9C depicts a side perspective view of the draw cord section of the backpack portion of FIG. 6B, prior to defining the draw cord tunnel of FIG. 9A, according to one or more embodiments shown and described herein.
Figure 9B:
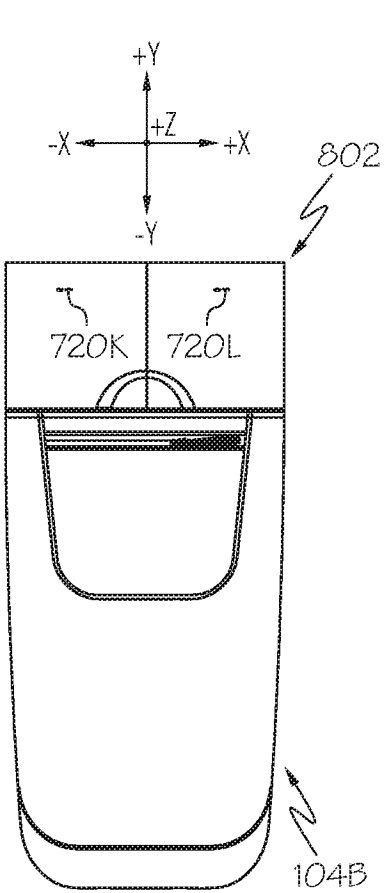
FIG. 9B depicts a front perspective view of the draw cord section of the backpack portion of FIG. 6B, prior to defining the draw cord tunnel of FIG. 9A, according to one or more embodiments shown and described herein.
Figure 9A:
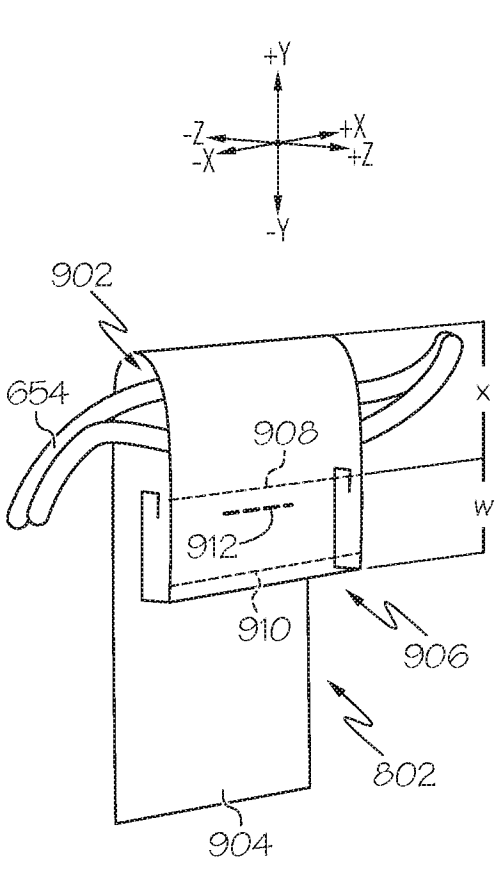
FIG. 9A depicts a detail view of an illustrative draw cord tunnel as defined in a draw cord section of the backpack portion of FIG. 6B, according to one or more embodiments shown and described herein.

FIG. 9A depicts a detail view of an illustrative draw cord tunnel 902 as defined in the draw cord section 802 of the backpack portion 104B of FIG. 6B, according to various aspects described herein. Referring to FIG. 9A, material 904 (e.g., a first material as described herein) of the draw cord section 802 may be folded over and fixedly attached to itself to define a double layer of material 906. In some aspects, the material 904 of the draw cord section 802 may be fixedly attached to itself via a first lateral stitching 908 (e.g., in the −x and +x directions of the coordinate axes of FIG. 9A) and/or a second lateral stitching 910 (e.g., in the −x and +x directions of the coordinate axes of FIG. 9A). In some aspects, the double layer of material 906 may be a width "w". In one aspect, for example, the width "w" may be about 1.5 cm. Still referring to FIG. 9A, the double layer of material 906 may then be folded over to define the draw cord tunnel 902. According to aspects described herein, the draw cord tunnel 902 may be sized such that the draw cord 654 is easily slidable (e.g., in the −x and +x directions of the coordinate axes of FIG. 9A) within the draw cord tunnel 902. In some aspects, the double layer of material 906 may be folded to define a draw cord tunnel 902 of width "x". In one aspect, for example, the width "x" may be about 3 cm. According to further aspects, a bar-tack 912 may fixedly attach the double layer of material 906 to the material 904 of the draw cord section 802. In one aspect, for example, the bar-tack 912 may be about a 1 cm wide bar-tack. In such aspects, the first lateral stitching 908 and/or the second lateral stitching 910 may not fixedly attach the double layer of material 906 to the material 904 of the draw cord section 802.

FIG. 9B depicts a front perspective view of the draw cord section 802 of the backpack portion 104B of FIG. 6B, prior to defining the draw cord tunnel 902 of FIG. 9A, according to various aspects of the present disclosure. FIG. 9B depicts illustrative bar-tack locations to define the draw cord tunnel 902 of FIG. 9A. Referring to FIG. 9B, the front of the draw cord section 802 (e.g., in the +z direction of the coordinate axes of FIG. 9B) may include bar-tack 720K and bar-tack 720L. FIG. 9C depicts a side perspective view of the draw cord section 802 of the backpack portion 104B of FIG. 6B, prior to defining the draw cord tunnel of FIG. 9A, according to various aspects of the present disclosure. FIG. 9C depicts an illustrative bar-tack location to define the draw cord tunnel 902 of FIG. 9A. Referring to FIG. 9C, the left side of the draw cord section 802 (e.g., in the +x direction of the coordinate axes of FIG. 9C) may include a bar-tack 720M. Here, it should be understood that the right side of the draw cord section 802 (e.g., in the −x direction of the coordinate axes of FIG. 9C) may similarly include such a bar-tack. FIG. 9D depicts a back perspective view of the draw cord section 802 of the backpack portion 104B of FIG. 6B, prior to defining the draw cord tunnel 902 of FIG. 9A, according to various aspects of the present disclosure. FIG. 9D depicts illustrative bar-tack locations to define the draw cord tunnel 902 of FIG. 9A. Referring to FIG. 9D, the back of the draw cord section 802 (e.g., in the −z direction of the coordinate axes of FIG. 9D) may include a bar-tack 720N and bar-tack 720P.

Figure 10:
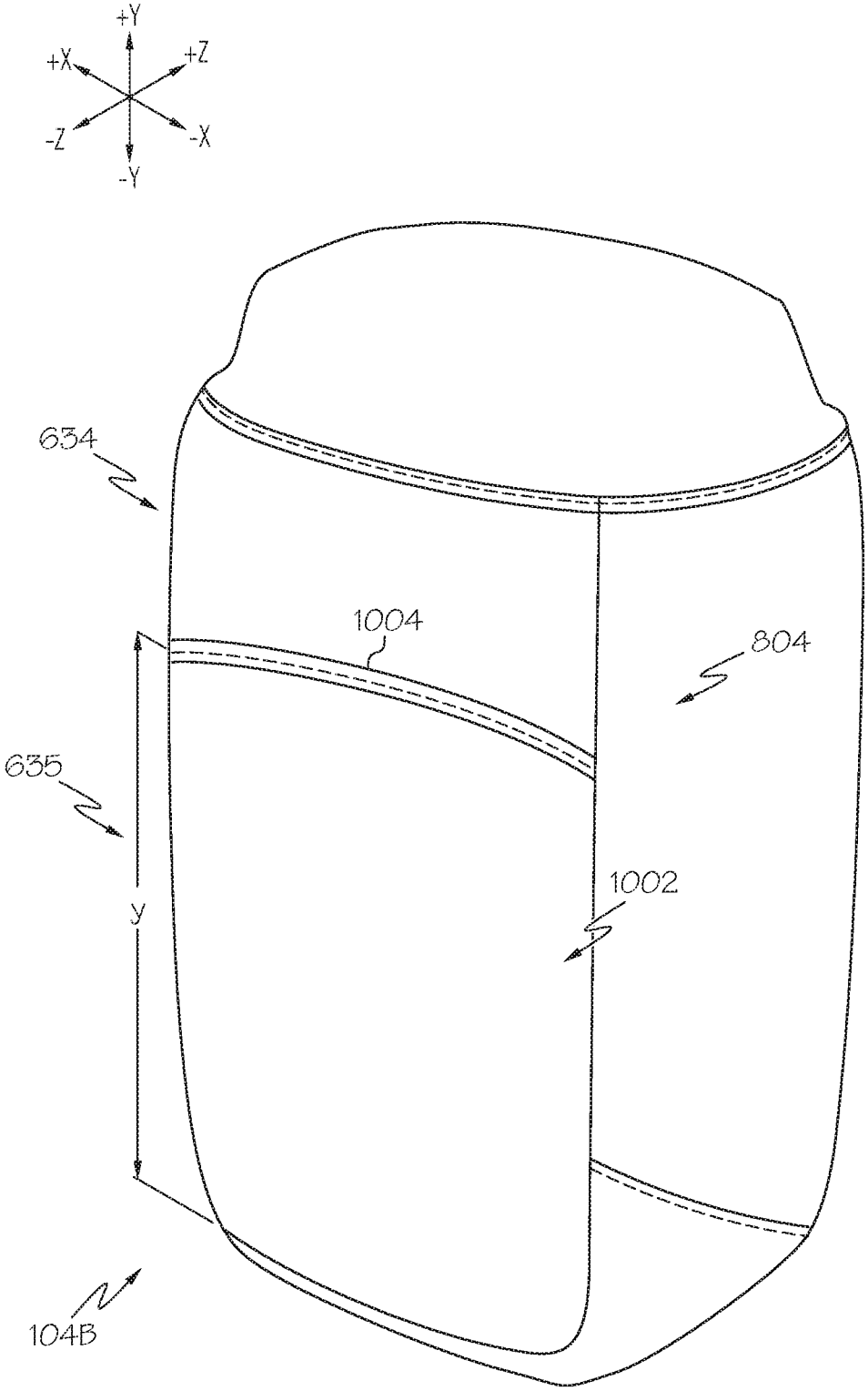
FIG. 10 depicts a back perspective view of the backpack portion of FIG. 6B including a further sleeve, according to one or more embodiments shown and described herein.

FIG. 10 depicts a back perspective view of the backpack portion 104B of FIG. 6B including a further sleeve, according to various aspects of the present disclosure. Further components of the backpack portion 104B, as described herein, have been removed for ease of illustration. Referring to FIG. 10, a sleeve 1002 may be defined on a lower section 635 (e.g., in the −y direction of the coordinate axes of FIG. 10) of a rear surface (e.g., in the −z direction of the coordinate axes of FIG. 10) of the main body section 804 of the backpack portion 104B. In some aspects, the sleeve 1002 may be defined by a first material. In other aspects, the sleeve 1002 may be defined by a material different than the first material. According to various aspects, the sleeve 1002 may be defined by a single layer of body fabric. In one aspect, for example, the first material may by a N70D Ripstop Liongxiang with WR C6 and PU 2000 mm. Further referring to FIG. 10, an edge binding 1004 may be defined at a top portion (e.g., in the +y direction of the coordinate axes of FIG. 10) of the sleeve 1002. According to various aspects, the edge binding 1004 may be elastic. In such aspects, the elastic edge binding 1004 may retain any objects positioned within the sleeve 1002. According to various aspects, sleeve 1004 may be extend (e.g., in the +y direction of the coordinate axes of FIG. 10) a length "y" from the lower section 635 of the backpack portion 104B. In one aspect, for example, the length "y" may be about 30 cm.

In light of FIG. 10, according to one aspect of the present disclosure, a sleeve 1002 may be defined on the rear surface (e.g., in the −z direction of the coordinate axes of FIG. 10) between a lower section 635 (e.g., in the −y direction of the coordinate axes of FIG. 10) and an upper section 634 (e.g., in the +y direction of the coordinate axes of FIG. 10) of the main body section 804 of the backpack portion 104B. More specifically, in such an aspect, the sleeve 1002 may be defined on the inside (e.g., of the backpack portion 104B) rather than the outside of the rear surface. Further in such an aspect, the sleeve 1002 may be configured such that a deployable frame 202A, 202B, as described herein, is further insertable within the sleeve 1002 inside the backpack portion 104B. After insertion, the frame 202A, 202B and sleeve 1002 may function in a manner similar to the carrier portion 102B as described herein (e.g., without the need for a separate carrier portion). According to various aspects, the backpack portion 104B of FIG. 10 may include similar components to those as described in FIGS. 7B-7E herein (e.g., handle, shoulder straps, waist straps, chest straps, and/or the like). According to various aspects, the sleeve 1002 may be configured such that the frame 202A, 202B is stowable within the sleeve 1002 when the frame 202A, 202B is in the collapsed state.

Figure 11:
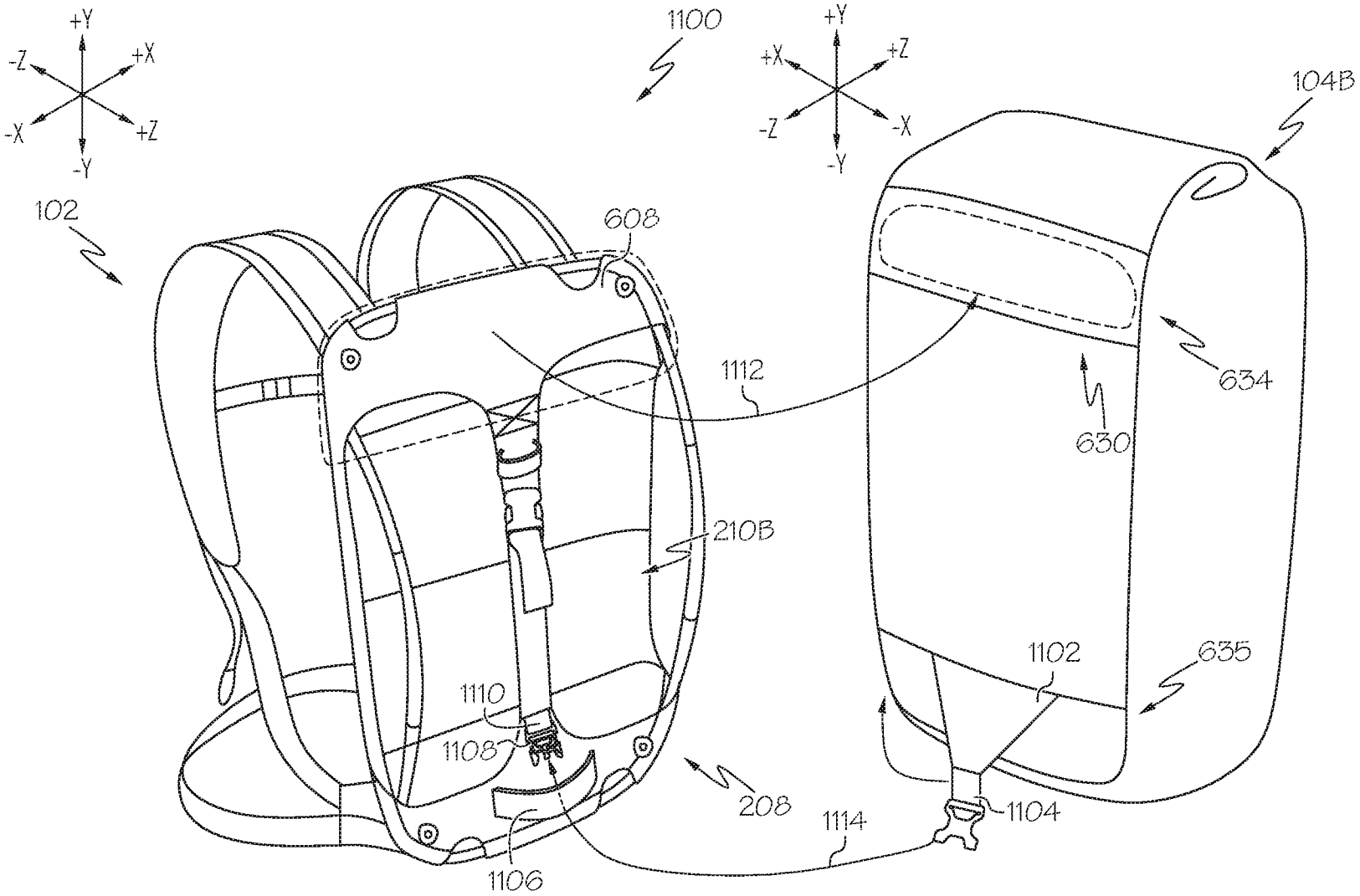
FIG. 11 depicts a backpack system including a carrier portion of FIG. 2 and a backpack portion of FIG. 6B including a further lower connector, according to one or more embodiments shown and described herein.

FIG. 11 depicts a backpack system 1100 including a carrier portion 102A of FIG. 2 and a backpack portion 104B of FIG. 6B including a further lower connector 1102, according to various aspects of the present disclosure. As described herein, the backpack portion 104B may include a sleeve 630 defined on the upper section 634 (e.g., in the +y direction of the coordinate axes of FIG. 11) of a rear surface (e.g., in the −z direction of the coordinate axes of FIG. 11) of the backpack portion 104B. The sleeve 630 may be configured to fittingly receive the upper part 608 of the carrier portion 102A (e.g., depicted via arrow 1112 of FIG. 11 and phantom lines for purposes of illustration). Referring to FIG. 11, the lower connector 1102 of the backpack portion 104B may include a first lower connector buckle element 1104. In some aspects, the lower connector 1102 may be an elastic material. In other aspects, the lower connector 1102 may be a first material as described herein or a material different than the first material. Further, in view of FIG. 11, the lower pocket 208 of the carrier portion 102A may include a lower connector loop 1106 fixedly attached to and positioned on a front surface (e.g., in the +z direction of the coordinate axes of FIG. 1) of the lower pocket 208. The anterior middle section 210B of the carrier portion 102A may include a further second lower connector buckle element 1108 fixedly or adjustably coupled to a lower connector strap 1110 of the anterior middle section 210B. According to various aspects, after inserting the upper part 608 of the carrier portion 102A into the sleeve 630 of the backpack portion 104B, the lower connector 1102 may be positioned down (e.g., in the −y direction of the coordinate axes of FIG. 11) over a front surface (e.g., in the +z direction of the coordinate axes of FIG. 11) of the lower connector loop 1106 and inserted up (e.g. in the +y direction of the coordinate axes of FIG. 11) between a back surface (e.g., in the −z direction of the coordinate axes of FIG. 11) of the lower connector loop 1106 and the lower pocket 208 (e.g., depicted via arrow 1114 of FIG. 11), and the first lower connector buckle element 1104 of the lower connector 1102 may be releasably coupled to the second lower connector buckle element 1108 of the carrier portion 102A to releasably secure the backpack portion 104B to the carrier portion 102A. In some aspects, when the lower connector 1102 is an elastic material, coupling the first lower connector buckle element 1104 to the second lower connector buckle element 1108 may create a tensile force to retain the upper part 608 of the carrier portion 102A in the sleeve 630 of the backpack portion.

According to yet further aspects of the present disclosure, in light of FIG. 11 and FIG. 2, the backpack portion 104B and the carrier portion 102A may be coupled by inserting the backpack portion 104B into the frame cavity 204 extending between the upper pocket 206 and the lower pocket 208 of the carrier portion 102A. In view of FIG. 2, such an aspect may include decoupling the buckle 218, inserting the backpack portion 104B into the frame cavity 204, the upper pocket 206, and/or the lower pocket 208, and recoupling the buckle 218.

It should now be understood that the backpack systems, including the backpack portions, the carrier portions, and/or the deployable frames described herein, are suitable for maintaining desired structural rigidity during use while being easily stowable when not in use. In particular, the frames, deployable to a deployed state during use, interact with various features of the backpack portions and/or carrier portions, as described herein, to permit multiple versatile backpack system configurations and functionalities, and the frames, collapsible to a collapsed state when not in use, effectively reduce a storage volume of the backpack system overall for improved stowability.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A backpack system, comprising:

a frame having a plurality of segments being coupled together to deploy the frame in a deployed state and decoupled to collapse the frame in a collapsed state; and a carrier portion comprising a middle portion having an upper strap including a first buckle element and a lower strap including a second buckle element, the upper strap being adjustable via the first buckle element and the lower strap being adjustable via the second buckle element such that the deployed state of the frame may be adjusted by adjusting the first strap and/or the second strap;

wherein the frame is removably insertable within an upper pocket and a lower pocket defined by the carrier portion to constrain the frame in the deployed state.

2. The backpack system of claim 1, wherein a predetermined curvature is defined by the frame such that the frame is in a predetermined bowed state when inserted within the carrier portion of the backpack system.

3. The backpack system of claim 1, wherein each frame segment of the plurality of frame segments:

couples to its adjacent frame segments to form a continuous frame in the deployed state; and decouples from its adjacent frame segments to form a collection of frame segments in the collapsed state.

4. A backpack system, comprising:

a frame that deploys to a deployed state and collapses to a collapsed state;

a carrier portion that defines an upper pocket and a lower pocket, wherein the upper pocket and the lower pocket constrain the frame in the deployed state, the carrier portion comprising a middle portion having an upper strap including a first buckle element and a lower strap including a second buckle element, the upper strap being adjustable via the first buckle element and the lower strap being adjustable via the second buckle element; and a backpack portion removably couplable to the carrier portion; and at least one strapping mechanism for removably coupling the backpack portion to the frame;

wherein the frame is at least partially constructed of an elastic material such that, when the frame is constrained by the upper pocket and the lower pocket of the carrier portion, the frame deflects to a bowed or curved state and wherein the bowed state of the frame is adjusted by adjusting the first strap and/or the second strap of the carrier portion.

5. The backpack system of claim 4, wherein:

at least one upper access void is defined in the upper pocket and at least one lower access void is defined in the lower pocket, and at least one section of an upper portion of the frame is exposed through the at least one upper access void and at least one section of a lower portion of the frame is exposed through the at least one lower access void.

6. The backpack system of claim 5, wherein the backpack portion comprises:

at least one upper attachment mechanism located on the backpack portion to correspond with the at least one exposed section of the upper portion of the frame, each of the at least one upper attachment mechanism to removably secure the backpack portion to an exposed section of the upper portion of the frame; and at least one lower attachment mechanism located on the backpack portion to correspond with the at least one exposed section of the lower portion of the frame, each of the at least one lower attachment mechanism to removably secure the backpack portion to an exposed section of the lower portion of the frame.

7. The backpack system of claim 4, wherein the frame comprises a plurality of frame segments and each frame segment:

couples to its adjacent frame segments to form a continuous frame in the deployed state; and decouples from its adjacent frame segments to form a collection of frame segments in the collapsed state.

8. The backpack system of claim 7, wherein each frame segment is defined by a hollow tube shape and each frame segment is maintained in association with its adjacent frame segments via an elastic cord threaded through the plurality of frame segments.

9. The backpack system of claim 4, wherein:

the carrier portion comprises an upper part; and a sleeve is defined on an upper section of the backpack portion, the sleeve to fittingly receive the upper part of the carrier portion to releasably secure the upper section of the backpack portion to the upper part of the carrier portion.

10. The backpack system of claim 9, wherein:

the carrier portion further comprises a lower part including one or more than one toggle loop; and one or more than one toggle is fixedly attached to a lower section of the backpack portion, the one or more than one toggle of the backpack portion being releasably insertable within the one or more than one toggle loop of the carrier portion to releasably secure the lower section the backpack portion to the lower part of the carrier portion and to retain the upper part of the carrier portion within the sleeve of the backpack portion.

11. A backpack system, comprising:

a carrier portion comprising a deployable frame positioned within an upper and lower pocket of the carrier portion, a middle portion having an upper strap including a first buckle element, and a lower strap including a second buckle element, the upper strap being adjustable via the first buckle element and the lower strap being adjustable via the second buckle element such that a bowed state of the frame may be adjusted by adjusting the first strap and/or the second strap;

a backpack portion defining a surface, the surface of the backpack portion to interface with the carrier portion; and at least one of a sleeve defined on the surface of the backpack portion and one or more than one attachment mechanism including at least one snapping mechanism and at least one hook tab, each of which are positioned on the surface of the backpack portion to removably couple the backpack portion and the carrier portion.

12. The backpack system of claim 11, wherein the backpack portion includes the one or more than one attachment mechanism, the one or more than one attachment mechanism comprising:

at least one upper attachment mechanism located on the backpack portion to correspond with an upper portion of the frame, each of the at least one upper attachment mechanism to removably secure the backpack portion to the upper portion of the frame; and at least one lower attachment mechanism located on the backpack portion to correspond with a lower portion of the frame, each of the at least one lower attachment mechanism to removably secure the backpack portion to the lower portion of the frame.

13. The backpack system of claim 11, wherein the backpack portion includes the sleeve, the sleeve to fittingly receive an upper part of the carrier portion to releasably secure the backpack portion to the carrier portion.

14. The backpack system of claim 13, further comprising one or more than one toggle fixedly attached to the surface of the backpack portion, the one or more than one toggle releasably insertable within one or more than one toggle loop of the carrier portion to releasably secure the backpack portion to the carrier portion and to retain the upper part of the carrier portion within the sleeve.

15. The backpack system of claim 4, wherein the backpack portion comprises a plurality of attachment mechanisms comprising:

at least one snapping mechanism and at least one hook tab for removably coupling the backpack portion to the carrier portion; and at least one strapping mechanism for removably coupling the backpack portion to the frame.

16. The backpack system of claim 1, wherein the frame comprises at least a first frame segment, a second frame segment, a third frame segment, and a fourth frame segment, and wherein each frame segment is telescopically coupled to its adjacent frame segment.

17. The backpack system of claim 11, wherein the surface of the backpack portion further comprises a strapping mechanism for removably coupling the backpack portion to the deployable frame.

* * * * *